US010932076B2

(12) United States Patent
Merks et al.

(10) Patent No.: US 10,932,076 B2
(45) Date of Patent: Feb. 23, 2021

(54) AUTOMATIC CONTROL OF BINAURAL FEATURES IN EAR-WEARABLE DEVICES

(71) Applicant: Starkey Laboratories, Inc., Eden Prairie, MN (US)

(72) Inventors: Ivo Merks, Eden Prairie, MN (US); John Ellison, Minneapolis, MN (US); Ke Zhou, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/528,225

(22) Filed: Jul. 31, 2019

(65) Prior Publication Data

US 2020/0045489 A1 Feb. 6, 2020

Related U.S. Application Data

(60) Provisional application No. 62/712,764, filed on Jul. 31, 2018.

(51) Int. Cl.

| | |
|---|---|
| ***H04S 7/00*** | (2006.01) |
| ***H04R 5/033*** | (2006.01) |
| ***H04R 1/10*** | (2006.01) |

(52) U.S. Cl.

CPC ..... *H04S 7/30* (2013.01); *H04R 1/1041* (2013.01); *H04R 5/033* (2013.01); *H04R 2420/07* (2013.01)

(58) Field of Classification Search

CPC ..... H04S 7/30; H04R 1/1041; H04R 5/033; H04R 2420/07

USPC ..... 381/311, 312, 23.1, 330, 380, 381, 56, 381/58, 374, 98; 455/41.3, 41.2

See application file for complete search history.

(56) References Cited

U.S. PATENT DOCUMENTS

| | | | |
|---|---|---|---|
| 5,764,778 | A | 6/1998 | Zurek |
| 7,016,510 | B2 | 3/2006 | Arndt et al. |

(Continued)

FOREIGN PATENT DOCUMENTS

| | | | |
|---|---|---|---|
| EP | 2590436 | A1 | 5/2013 |
| WO | 2014184395 | A2 | 11/2014 |

OTHER PUBLICATIONS

Phonak, "StereoZoom and auto StereoZoom", 2013 (Applicant points out, in accordance with MPEP 609.04(a), that the year of publication, 2013, is sufficiently earlier than the effective U.S. filing date, so that the particular month of publication is not in issue.), 7 pp.

(Continued)

*Primary Examiner* — Vivian C Chin
*Assistant Examiner* — Con P Tran
(74) *Attorney, Agent, or Firm* — Shumaker & Sieffert, P.A.

(57) ABSTRACT

A local device of an auditory device system is configured to perform a process that switches between operating modes. As part of the process, the local device may determine a wireless quality parameter indicative of a current environment for wireless communication with the contra device. Additionally, based on the one or more local input audio signals and the wireless quality parameter, the local device may determine whether to change a local active operating mode of the local device from a bilateral mode to a binaural mode or from the binaural mode to the bilateral mode. The local device may generate a local output audio signal based on the one or more local input audio signals in accordance with the local active operating mode and may produce sound based on the local output audio signal.

14 Claims, 14 Drawing Sheets

(56) References Cited

U.S. PATENT DOCUMENTS

| | | | | |
|---|---|---|---|---|
| 8,130,990 | B2 | 3/2012 | Reithinger | |
| 8,396,224 | B2 | 3/2013 | Dittberner | |
| 8,630,431 | B2 | 1/2014 | Gran | |
| 9,313,577 | B2 | 4/2016 | Bodvarsson et al. | |
| 9,473,860 | B2 | 10/2016 | Fischer et al. | |
| 9,763,016 | B2 | 9/2017 | Merks et al. | |
| 10,149,072 | B2 * | 12/2018 | Long | H04R 25/552 |
| 2007/0291969 | A1 | 12/2007 | Tateno et al. | |
| 2011/0125218 | A1 * | 5/2011 | Busby | A61N 1/36036 607/57 |
| 2012/0008807 | A1 | 1/2012 | Gran | |
| 2013/0108058 | A1 * | 5/2013 | Launer | H04R 25/552 381/23.1 |
| 2015/0124975 | A1 * | 5/2015 | Pontoppidan | H04R 25/552 381/23.1 |
| 2015/0374988 | A1 * | 12/2015 | Laudanski | A61N 1/0541 607/57 |
| 2016/0057547 | A1 * | 2/2016 | Burger | H04R 25/00 381/315 |

OTHER PUBLICATIONS

Kamkar-Parsi, "Improving Speech Intelligibility in Noise with Binaural Beamforming", https://pdfs.semanticscholar.org/dd23/a0f38b6a0adcd8c400509d71eeed3bd3113d.pdf, 2014 (Applicant points out, in accordance with MPEP 609.04(a), that the year of publication, 2014, is sufficiently earlier than the effective U.S. filing date, so that the particular month of publication is not in issue.), 12 pp.

Lotter et al., "Dual-Channel Speech Enhancement by Superdirective Beamforming," EURASIP Journal on Applied Signal Processing, vol. 2006, Article 63297, Dec. 2006, 14 pp.

Extended European Search Report from counterpart European Application No. 19186386.9, dated Nov. 29, 2019, 7 pp.

Kates, "Adaptive and Multimicrophone Arrays," Digital Hearing Aids, 2008 (Applicant points out, in accordance with MPEP 609.04(a), that the year of publication, 2008, is sufficiently earlier than the effective U.S. filing date, so that the particular month of publication is not in issue.) pp. 113-145.

Doclo et al., "Acoustic Beamforming for Hearing Aid Applications," Handbook on Array Processing and Sensor Networks, 2009 Applicant points out, in accordance with MPEP 609.04(a), that the year of publication, 2009, is sufficiently earlier than the effective U.S. filing date, so that the particular month of publication is not in issue.) pp. 269-302.

Loizou, "Speech Enhancement Theory and Practice," Second Edition, CRC Press, 2013 Applicant points out, in accordance with MPEP 609.04(a), that the year of publication, 2013, is sufficiently earlier than the effective U.S. filing date, so that the particular month of publication is not in issue.), 12 pp.

Response to Extended European Search Report from counterpart European Application No. 19186386.9, filed Jul. 22, 2020, 19 pp.

* cited by examiner

AUTOMATIC CONTROL OF BINAURAL FEATURES IN EAR-WEARABLE DEVICES

This application claims the benefit of U.S. Provisional Patent Application 62/712,764, filed Jul. 31, 2018, the entire content of which is incorporated by reference.

TECHNICAL FIELD

This disclosure relates to ear-wearable devices.

BACKGROUND

A user may use one or more ear-wearable devices for various purposes. For example, a user may use ear-wearable devices to enhance the user's ability to hear sound. In another example, a user may use ear-wearable devices to listen to media, such as music or television. Example types of ear-wearable devices include hearing aids, earbuds, headphones, earphones, and so on. A typical ear-wearable device includes one or more microphones. The ear-wearable device may generate an audio signal representing a mix of sounds received by the one or more microphones and produce a modified version of the received sound based on the audio signal. The modified version of the received sound may be louder or quieter than the received sound.

Problems of speech intelligibility are common among users of ear-wearable devices. In other words, it may be difficult for a user of an ear-wearable device to differentiate speech sounds from background sounds or other types of sounds. Binaural beamforming is a technique designed to increase the volume of voice sounds output by ear-wearable devices relative to other sounds. That is, binaural beamforming may increase the signal-to-noise ratio of voice sounds. A user of ear-wearable devices that use binaural beamforming wears two ear-wearable devices, one for each ear. Hence, the ear-wearable devices are said to be binaural. The binaural ear-wearable devices may communicate with each other. In general, binaural beamforming works by selectively canceling sounds that do not originate from a focal direction, such as directly in front of the user, while maintaining or potentially reinforcing sounds that originate from the focal direction. Thus, binaural beamforming may cancel noise, where noise is considered to be sound not originating from the focal direction. Binaural noise reduction uses the microphone signals of both hearing aid to calculate a frequency- and time-dependent gain that is proportional to the SNR and binaural noise reduction applies this gain to both the left and right microphone signal. Because binaural noise reduction applies the same gain to speech and to the noise, binaural noise reduction does not improve speech intelligibility (unlike binaural beamforming). One example of a binaural noise reduction algorithm is described in Lotter et al, "Dual-channel speech enhancement by superdirective beamforming," EURASIP Journal on Advances in Signal Processing, 2006 (1), p. 063297.

SUMMARY

This disclosure describes techniques for switching operating modes of ear-wearable devices. In one example, this disclosure describes a method for switching operating modes of ear-wearable devices, the method comprising: generating, by a local device of an auditory device system, one or more local input audio signals based on sound detected by one or more microphones of the local device, wherein the auditory device system includes the local device and a contra device, the local device and the contra device being ear-wearable devices; determining, by the local device, a wireless quality parameter indicative of a current environment for wireless communication with the contra device; determining, based on the one or more local input audio signals and the wireless quality parameter, by the local device, whether to change a local active operating mode of the local device from a bilateral mode to a binaural mode or from the binaural mode to the bilateral mode; changing, by the local device, the local active operating mode based on the determination; generating, by the local device, a local output audio signal based on the one or more local input audio signals in accordance with the local active operating mode; and producing, by a receiver of the local device, sound based on the local output audio signal. In some examples, when the local active operating mode is the binaural mode, the local device wirelessly receives a contra intermediate audio signal from the contra device, generates the local output audio signal based on the one or more local input audio signals and the contra intermediate audio signal, and wirelessly transmits a local intermediate audio signal to the contra device, the local intermediate audio signal being based on the one or more local input audio signals, and, when the local active operating mode is the bilateral mode, the local device does not wirelessly receive the contra intermediate audio signal from the contra device and the local device generates the local output audio signal based on the one or more local input audio signals.

In another example, this disclosure describes an ear-wearable device comprising: one or more microphones; a receiver; and one or more processors configured to: generate one or more local input audio signals based on sound detected by the one or more microphones, wherein the ear-wearable device is a local device, an auditory device system includes the local device and a contra device, and the contra device is a second ear-wearable device; determine a wireless quality parameter indicative of a current environment for wireless communication with the contra device; determine, based on the one or more local input audio signals and the wireless quality parameter, whether to change a local active operating mode of the local device from a bilateral mode to a binaural mode or from the binaural mode to the bilateral mode; change the local active operating mode based on the determination; generate a local output audio signal based on the one or more local input audio signals in accordance with the local active operating mode, wherein the receiver is configured to produce sound based on the local output audio signal. In some examples, when the local active operating mode is the binaural mode, the ear-wearable device wirelessly receives a contra intermediate audio signal from the contra device, generates the local output audio signal based on the one or more local input audio signals and the contra intermediate audio signal, and wirelessly transmits a local intermediate audio signal to the contra device, the local intermediate audio signal being based on the one or more local input audio signals, and when the local active operating mode is the bilateral mode, the ear-wearable device does not wirelessly receive the contra intermediate audio signal from the contra device and the local device generates the local output audio signal based on the one or more local input audio signals.

In another example, this disclosure describes an ear-wearable device comprising: means for generating one or more local input audio signals based on sound detected by one or more microphones of the local device, wherein the auditory device system includes the local device and a contra device, the local device and the contra device being ear-wearable devices; means for determining a wireless quality parameter indicative of a current environment for wireless communication with the contra device; means for determining, based on the one or more local input audio signals and the wireless quality parameter, whether to change a local active operating mode of the local device from a bilateral mode to a binaural mode or from the binaural mode to the bilateral mode; means for changing the local active operating mode based on the determination; means for generating a local output audio signal based on the one or more local input audio signals in accordance with the local active operating mode; and means for producing sound based on the local output audio signal.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Figure 1:
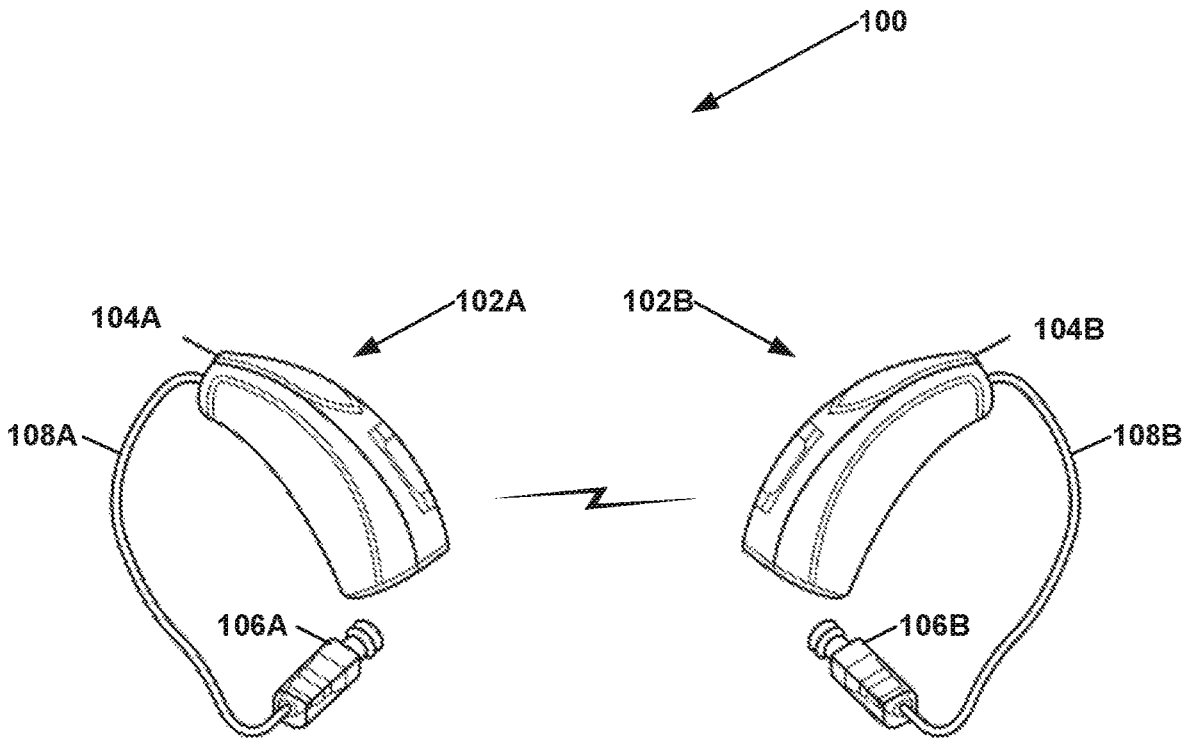
FIG. 1 illustrates an example hearing assistance system that includes a first ear-wearable device and a second ear-wearable device, in accordance with one or more techniques of this disclosure.

Binaural features, such as binaural noise reduction and binaural beamforming, may improve audibility and overall user experience. However, the same binaural features may be disadvantageous under certain circumstances. For instance, binaural beamforming may reduce or eliminate the spatial cues that a user may use to locate sound sources. Furthermore, the use of binaural features may require ear-wearable devices to communicate wirelessly, which consumes a significant amount of electrical energy from the batteries of the ear-wearable devices.

Thus, processes have previously been developed to switch between an operating mode in which ear-wearable devices use binaural features and an operating mode in which the ear-wearable devices do not use binaural features. For example, one switching process enables binaural beamforming when a volume level is above 70 dB sound pressure level (SPL) and if a percentage of speech in noise is at least 85%. In this example, the switching process enables binaural audio transmission above a certain threshold. In this disclosure, binaural audio transmission refers to the two-way ear-to-ear transmission of audio signals between ear-wearable devices of an auditory device system. Furthermore, in this example, the switching process parameterizes the binaural beamformer depending on an analysis of the binaural signals. Other switching processes rely on binaural audio transmission to determine whether to switch to or from an operating mode in which hearing aids use binaural features.

However, such switching processes may have some significant shortcomings. For example, estimating a percentage of speech in noise may be difficult at high noise levels, which may easily result in misclassification and over-switching (i.e., switching too frequently). Over-switching may diminish the user's experience. Furthermore, speech is not consistently present and an estimate that relies on the presence of speech can result in missing onsets of speech or excessive switching. Relying on binaural audio transmission to determine whether to switch to or from an operating mode in which hearing aids use binaural features may reduce battery life.

This disclosure describes techniques for switching operating modes of ear-wearable devices. The switching techniques of this disclosure may allow ear-wearable devices, such as hearing aids, to switch to/from binaural features, such as binaural noise reduction and binaural beamforming. The switching techniques of this disclosure may enable ear-wearable devices to switch into/out of binaural features in an effective, efficient, and robust manner. The switching techniques of this disclosure are effective because the ear-wearable devices only use the binaural audio transmission in acoustic environments where the binaural feature is effective. The switching techniques of this disclosure, in some examples, may be efficient because they may limit wireless ear-to-ear (E2E) communication as much as possible. The switching techniques of this disclosure, in some examples, are robust because the switching techniques of this disclosure typically only switch once per acoustic environment, thereby limiting the perceptual switching effect for the listener.

FIG. 1 illustrates an example auditory device system 100 that includes a first ear-wearable device 102A and a second ear-wearable device 102B, in accordance with one or more techniques of this disclosure. This disclosure may refer to ear-wearable device 102A and ear-wearable device 102B collectively as ear-wearable devices 102. Ear-wearable devices 102 may be wearable concurrently in different ears of the same user.

In the example of FIG. 1, ear-wearable devices 102 are shown as receiver-in-canal (RIC) style hearing aids. Thus, in the example of FIG. 1, ear-wearable device 102A includes a receiver-in-the-canal (RIC) unit 104A, a receiver unit 106A, and a communication cable 108A. Communication cable 108A communicatively couples RIC unit 104A and receiver unit 106A. Similarly, ear-wearable device 102B includes a RIC unit 104B, a receiver unit 106B, and a communication cable 108B. Communication cable 108B communicatively couples RIC unit 104B and receiver unit 106B. This disclosure may refer to RIC unit 104A and RIC unit 104B collectively as RIC units 104. Additionally, this disclosure may refer to receiver unit 106A and receiver unit 106B as collectively receiver units 106. This disclosure may refer to communication cable 108A and communication cable 108B collectively as communication cables 108.

In other examples of this disclosure, auditory device system 100 includes other types of ear-wearable devices. For example, auditory device system 100 may include in-the-ear (ITE) devices. Example types of ITE devices that may be used with the techniques of this disclosure may include invisible-in-canal (IIC) devices, completely-in-canal (CIC) devices, in-the-canal (ITC) devices, and other types of ear-wearable devices that reside within the user's ear. In instances where the techniques of this disclosure are implemented in ITE devices, the functionality and components described in this disclosure with respect to RIC unit 104A and receiver unit 106A may be integrated into a single ITE device and the functionality and components described in this disclosure with respect to RIC unit 104B and receiver unit 106B may be integrated into a single ITE device. In some examples, smaller devices (e.g., CIC devices and ITC devices) each include only one microphone; other devices (e.g., RIC devices and BTE devices) may include two or more microphones. In still other examples, ear-wearable devices 102 may be implemented as earbuds, headphones, earphones, auditory devices for mixed or augmented reality applications, auditory devices for inter-personal communication, and so on.

In the example of FIG. 1, ear-wearable device 102A may wirelessly communicate with ear-wearable device 102B and ear-wearable device 102B may wirelessly communicate with ear-wearable device 102A. This disclosure may refer to communication between ear-wearable device 102A and ear-wearable device 102B as ear-to-ear (E2E) communication. In some examples, RIC units 104 include transmitters and receivers (e.g., transceivers) that support wireless communication between ear-wearable devices 102. In some examples, receiver units 106 include such transmitters and receivers (e.g., transceivers) that support wireless communication between ear-wearable devices 102.

Each of ear-wearable devices 102 operates in an operating mode in a plurality of operating modes. In typical circumstances, both of ear-wearable devices 102 operate in the same operating mode at any given time. The plurality of operating modes includes at least a binaural mode and a bilateral mode. When operating in the binaural mode, one or more binaural features (e.g., binaural noise reduction, binaural beamforming, etc.) are enabled. When operating in the bilateral mode, the binaural features are disabled. In accordance with the techniques of this disclosure, ear-wearable devices 102 individually perform a process for switching operating modes of ear-wearable devices 102. These techniques are described in detail below.

Figure 2:
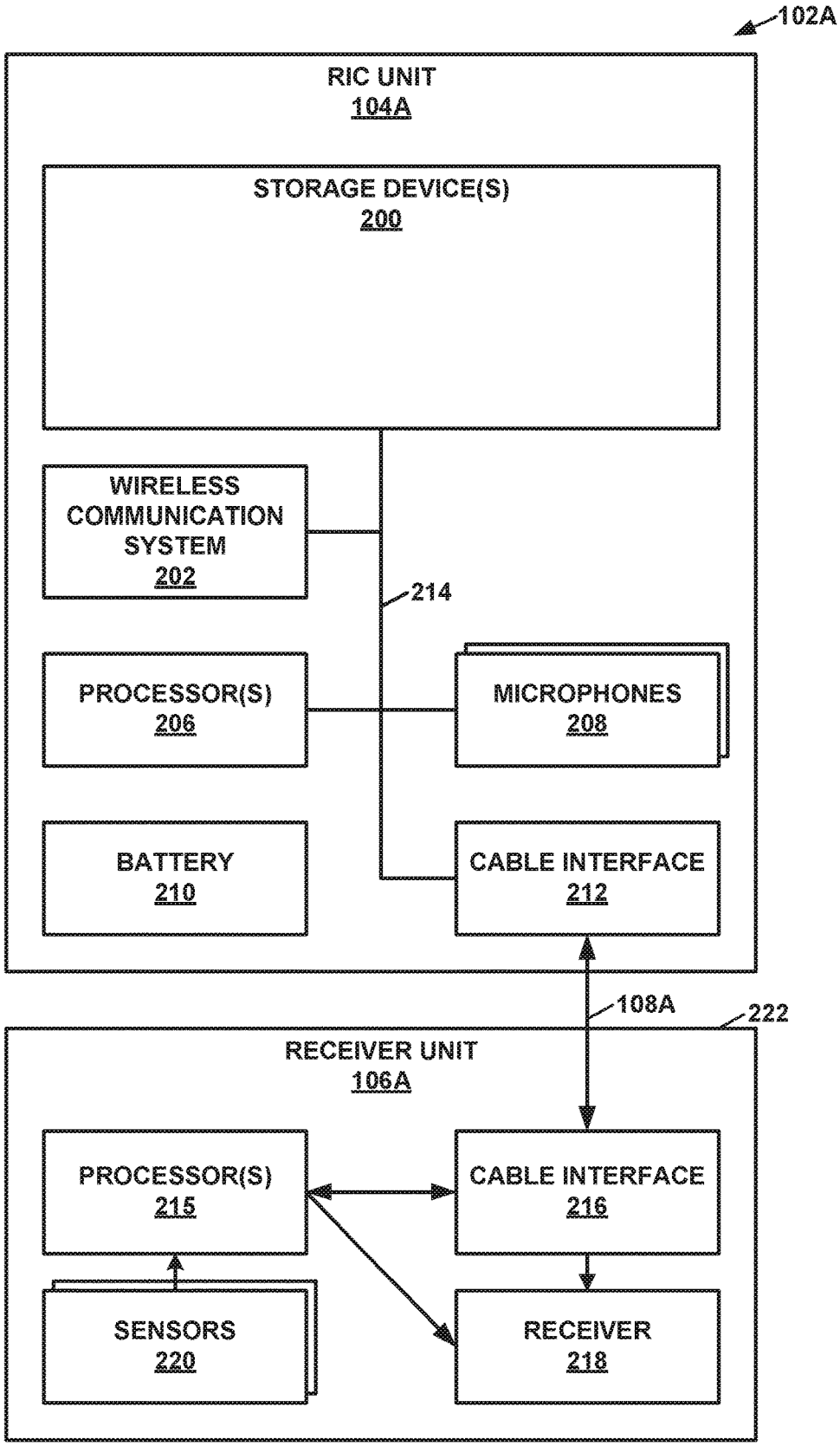
FIG. 2 is a block diagram illustrating example components of a receiver-in-canal (RIC) device that includes a RIC unit and a receiver unit configured according to one or more techniques of this disclosure.

FIG. 2 is a block diagram illustrating example components of ear-wearable device 102A that includes RIC unit 104A and receiver unit 106A configured according to one or more techniques of this disclosure. Ear-wearable device 102B may include similar components to those shown in FIG. 2.

In the example of FIG. 2, RIC unit 104A includes one or more storage device(s) 200, a wireless communication system 202, one or more processor(s) 206, one or more microphones 208, a battery 210, a cable interface 212, and one or more communication channels 214. Communication channels 214 provide communication between storage device(s) 200, wireless communication system 202, processor(s) 206, microphones 208, and cable interface 212. Storage devices 200, wireless communication system 202, processors 206, microphones 208, cable interface 212, and communication channels 214 may draw electrical power from battery 210, e.g., via appropriate power transmission circuitry. In other examples, RIC unit 104A may include more, fewer, or different components. For instance, RIC unit 104A may include a wired communication system instead of a wireless communication system.

Furthermore, in the example of FIG. 2, receiver unit 106A includes one or more processors 215, a cable interface 216, a receiver 218, and one or more sensors 220. In other examples, receiver unit 106A may include more, fewer, or different components. For instance, in some examples, receiver unit 106A does not include sensors 220 or receiver unit 106A may include an acoustic valve that provides occlusion when desired. In some examples, receiver unit 106A has a housing 222 that may contain some or all components of receiver unit 106A (e.g., processors 215, cable interface 216, receiver 218, and sensors 220). Housing 222 may be a standard shape or may be customized to fit a specific user's ear.

Storage device(s) 200 of RIC unit 104A include devices configured to store data. Such data may include computer-executable instructions, such as software instructions or firmware instructions. Storage device(s) 200 may include volatile memory and may therefore not retain stored contents if powered off. Examples of volatile memories may include random access memories (RAM), dynamic random access memories (DRAM), static random access memories (SRAM), and other forms of volatile memories known in the art. Storage device(s) 200 may further be configured for long-term storage of information as non-volatile memory space and retain information after power on/off cycles. Examples of non-volatile memory configurations may include flash memories, or forms of electrically programmable memories (EPROM) or electrically erasable and programmable (EEPROM) memories.

Wireless communication system 202 may enable RIC unit 104A to send data to and receive data from one or more other computing devices. For example, wireless communication system 202 may enable RIC unit 104A to send data to and receive data from ear-wearable device 102B. Wireless communication system 202 may use various types of wireless technology to communicate. For instance, wireless communication system 202 may use Bluetooth, 3G, 4G, 4G LTE, ZigBee, WiFi, Near-Field Magnetic Induction (NFMI), or another communication technology. In other examples, RIC unit 104A includes a wired communication system that enables RIC unit 104A to communicate with one or more other devices, such as ear-wearable device 102B, via a communication cable, such as a Universal Serial Bus (USB) cable or a Lightning™ cable.

Microphones 208 are configured to convert sound into electrical signals. In other words, microphones 208 may generate one or more input audio signals. In some examples, microphones 208 include a front microphone and a rear microphone. The front microphone may be located closer to the front (i.e., ventral side) of the user. The rear microphone may be located closer to the rear (i.e., dorsal side) of the user. In some examples, microphones 208 are included in receiver unit 106A instead of RIC unit 104A. In some examples, one or more of microphones 208 are included in RIC unit 104A and one or more of microphones 208 are included in receiver unit 106A. One or more of microphones 208 are omnidirectional microphones, directional microphones, or another type of microphones.

Processors 206 include circuitry configured to process information. RIC unit 104A may include various types of processors 206. For example, RIC unit 104A may include one or more microprocessors, digital signal processors, microcontroller units, and other types of circuitry for processing information. In some examples, one or more of processors 206 may retrieve and execute instructions stored in one or more of storage devices 200. The instructions may include software instructions, firmware instructions, or another type of computer-executed instructions. In accordance with the techniques of this disclosure, processors 206 may perform processes for switching an operating mode of ear-wearable device 102A between a binaural mode and a bilateral mode. In different examples of this disclosure, processors 206 may perform such processes fully or partly by executing such instructions, or fully or partly in hardware, or a combination of hardware and execution of instructions. In some examples, the processes for switching the operating mode of ear-wearable device 102A are performed entirely or partly by processors of devices outside ear-wearable device 102A, such as by a smartphone or other mobile computing device.

In the example of FIG. 2, cable interface 212 is configured to connect RIC unit 104A to communication cable 108A. Communication cable 108A enables communication between RIC unit 104A and receiver unit 106B. For instance, cable interface 212 may include a set of pins configured to connect to wires of communication cable 108A. In some examples, cable interface 212 includes circuitry configured to convert signals received from communication channels 214 to signals suitable for transmission on communication cable 108A. Cable interface 212 may also include circuitry configured to convert signals received from communication cable 108A into signals suitable for use by components in RIC unit 104A, such as processors 206. In some examples, cable interface 212 is integrated into one or more of processors 206. Communication cable 108 may also enable RIC unit 104A to deliver electrical energy to receiver unit 106.

In some examples, communication cable 108A includes a plurality of wires. The wires may include a Vdd wire and a ground wire configured to provide electrical energy to receiver unit 106A. The wires may also include a serial data wire that carries data signals and a clock wire that carries a clock signal. For instance, the wires may implement an Inter-Integrated Circuit ($I^2C$ bus). Furthermore, in some examples, the wires of communication cable 108A may include receiver signal wires configured to carry electrical signals that may be converted by receiver 218 into sound.

In the example of FIG. 2, cable interface 216 of receiver unit 106A is configured to connect receiver unit 106A to communication cable 108A. For instance, cable interface 216 may include a set of pins configured to connect to wires of communication cable 108A. In some examples, cable interface 216 includes circuitry that converts signals received from communication cable 108A to signals suitable for use by processors 215, receiver 218, and/or other components of receiver unit 106A. In some examples, cable interface 216 includes circuitry that converts signals generated within receiver unit 106A (e.g., by processors 215, sensors 220, or other components of receiver unit 106A) into signals suitable for transmission on communication cable 108A.

Receiver unit 106A may include various types of sensors 220. For instance, sensors 220 may include accelerometers, heartrate monitors, temperature sensors, and so on. Like processors 206, processors 215 include circuitry configured to process information. For example, processors 215 may include one or more microprocessors, digital signal processors, microcontroller units, and other types of circuitry for processing information. In some examples, processors 215 may process signals from sensors 220. In some examples, processors 215 process the signals from sensors 220 for transmission to RIC unit 104A. Signals from sensors 220 may be used for various purposes, such as evaluating a health status of a user of ear-wearable device 102A, determining an activity of a user (e.g., whether the user is in a moving car, running), and so on.

Processors 206 and/or processors 215 may generate a local output audio signal based on the one or more input audio signals generated by microphones 208 in accordance with a local active operating mode of ear-wearable device 102A. When operating in a binaural mode, wireless communication system 202 may wirelessly receive a contra intermediate audio signal from a contra device (e.g., ear-wearable device 102B) of auditory device system 100. Furthermore, when operating in the binaural mode, processors 206 and/or processors 215 may generate the local output audio signal based on the one or more local input audio signals and the contra intermediate audio signal. Additionally, when operating in the binaural mode, wireless communication system 202 may wirelessly transmit a local intermediate audio signal to the contra device. The local intermediate audio signal is based on the one or more local input audio signals. When the local active operating mode is the bilateral mode, ear-wearable device 102A does not wirelessly receive the contra intermediate audio signal from the contra device and processors 206 and/or processors 215 of ear-wearable device 102A may generate the local output audio signal based on the one or more local input audio signals, without use of a contra intermediate audio signal.

Receiver 218 includes one or more loudspeakers for producing sound based on the local output audio signal. Receiver 218 is so named because receiver 218 is ultimately the component of ear-wearable device 102A that receives signals to be converted into soundwaves. In some examples, the speakers of receiver 218 include one or more woofers, tweeters, woofer-tweeters, or other specialized speakers for providing richer sound.

In other examples, ear-wearable devices 102 (FIG. 1) may be implemented as a BTE device in which components shown in receiver unit 106A are included in RIC unit 104A and a sound tube extends from receiver 218 into the user's ear. The sound tube may comprise an air-filled tube that channels sound into the user's ear. In such examples, cable interface 212, cable interface 216, and processors 215 may be omitted. Furthermore, in such examples, receiver 218 may be integrated into the RIC unit.

Figure 3:
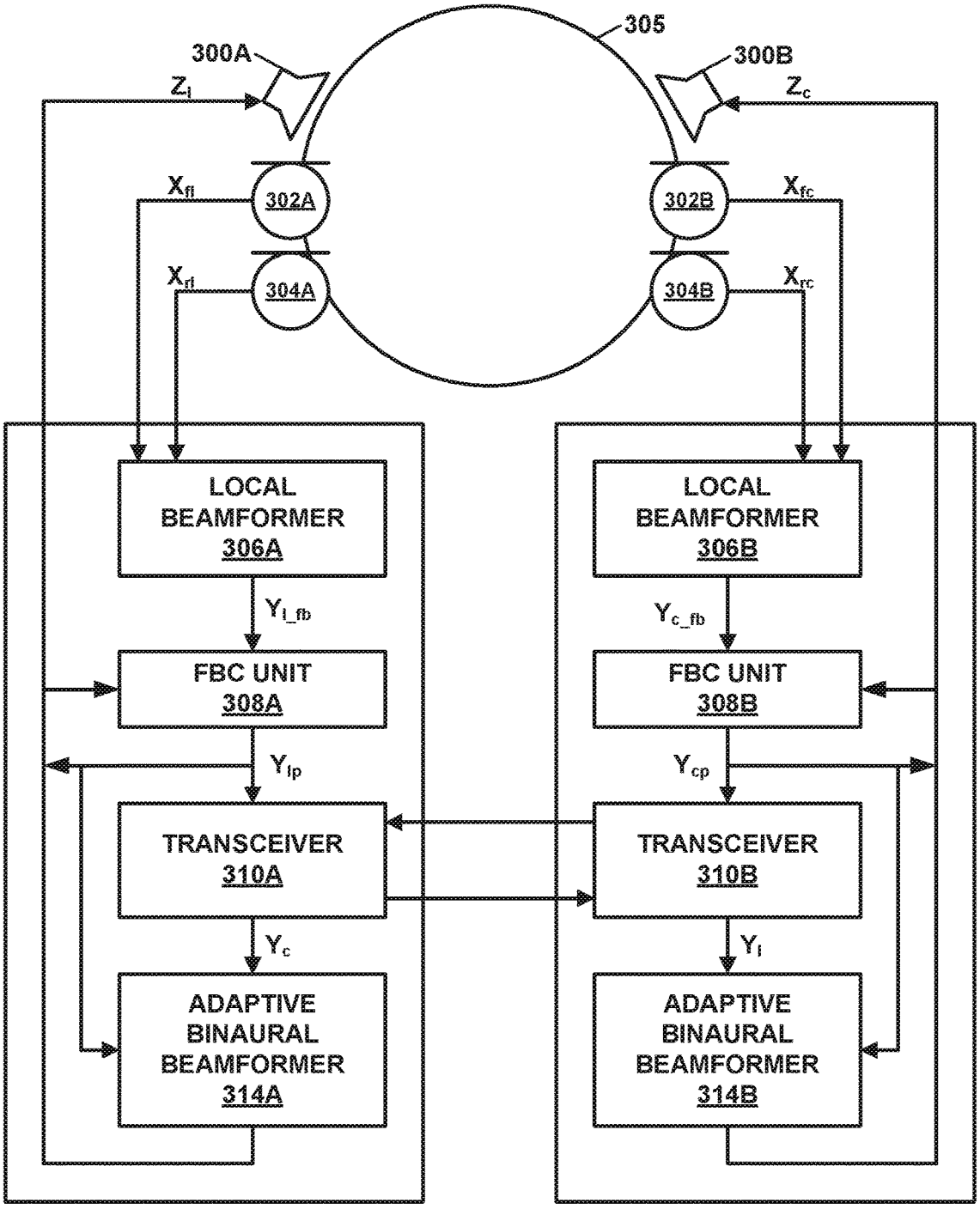
FIG. 3 is a block diagram illustrating an adaptive binaural beam forming system implemented in a hearing assistance system, in accordance with a technique of this disclosure.

FIG. 3 is a block diagram illustrating an adaptive binaural beam forming system implemented in auditory device system 100 (FIG. 1). This disclosure describes FIG. 3 according to a convention in which ear-wearable device 102A is the "local" ear-wearable device and ear-wearable device 102B is the "contra" ear-wearable device. Hence, signals associated with the local ear-wearable device may be denoted with the subscript "l" and signals associated with the contra ear-wearable device may be denoted with the subscript "c."

In the example of FIG. 3, a receiver 300A of ear-wearable device 102A, a front local microphone 302A of ear-wearable device 102A, and a rear local microphone 304A of ear-wearable device 102A are located on one side of a user's head 305. Front local microphone 302A and rear local microphone 304A may be among microphones 208 (FIG. 2). Receiver 300A may be receiver 218 (FIG. 2). A receiver 300B of ear-wearable device 102B, a front contra microphone 302B of ear-wearable device 102B, and a rear contra microphone 304B of ear-wearable device 102B are located on an opposite side of the user's head 305.

Furthermore, in the example of FIG. 3, ear-wearable device 102A includes a local beamformer 306A, a feedback cancellation (FBC) unit 308A, a transceiver 310A, and an adaptive binaural beamformer 314A. Processors 206, processors 215 (FIG. 2), or other processors may implement local beamformer 306A, FBC unit 308A, and adaptive binaural beamformer 314A. In some examples, such processors may include dedicated circuitry for performing the functions of local beamformer 306A, FBC unit 308A, and adaptive binaural beamformer 314A, or the functions of these components may be implemented by execution of software by one or more of processors 206 and/or processors 215. Wireless communication system 202 (FIG. 2) may include transceiver 310A.

Ear-wearable device 102B includes a local beamformer 306B, an FBC unit 308B, a transceiver 310B, and an adaptive binaural beamformer 314B. Local beamformer 306B, FBC unit 308B, transceiver 310B, and adaptive binaural beamformer 314B may be implemented in ear-wearable device 102B in similar ways as local beamformer 306A, FBC unit 308A, transceiver 310A, and adaptive binaural beamformer 314A are implemented in ear-wearable device 102A. Although the example of FIG. 3 shows two microphones on either side of the user's head 305, a similar system may work with a single microphone on either side of the user's head 305. In such examples, local beamformers 306 may be omitted.

In the example of FIG. 3, local beamformer 306A receives a microphone signal ($X_{fl}$) from front local microphone 302A and a microphone signal ($X_{rl}$) from rear local microphone 304A. Local beamformer 306A combines microphone signal $X_{fl}$ and microphone signal $X_{rl}$ into a signal $Y_{1_fb}$. The signal $Y_{1_fb}$ is so named because it is a local signal that may include feedback (fb). An example implementation of a local beamformer, such as local beamformer 306A and local beamformer 306B is described below with reference to FIG. 14. Feedback may be present in microphone signals $X_{fl}$ and $X_{rl}$ because front local microphone 302A and/or rear local microphone 304A may receive soundwaves generated by receiver 300A and/or receiver 300B. Accordingly, in the example of FIG. 3, FBC unit 308A may use signal $Z_l$ to cancel the feedback in signal $Y_{1_fb}$, resulting in signal $Y_{lp}$. Signal $Y_{lp}$ is so named because it is a local (l) signal that has been processed (p). This disclosure may refer to signal $Y_{lp}$ as a local intermediate audio signal when the local device applies binaural beamforming. FBC unit 308A may be implemented in various ways. For instance, in one example, FBC unit 308A may apply a notch filter that attenuates a system response over frequency regions where feedback is most likely to occur. In some examples, FBC unit 308A may use an adaptive feedback cancellation system. Kates, "Digital Hearing Aids," Plural Publishing (2008), pp. 113-145, describes various feedback cancellation systems.

Transceiver 310A of ear-wearable device 102A may transmit a version of signal $Y_{lp}$ to transceiver 310B of ear-wearable device 102B. Adaptive binaural beamformer 314B may generate an output signal $Z_c$ based in part on a signal $Y_l$ and a signal $Y_{cp}$. Signal $Y_l$ is, or is based on, signal $Y_{lp}$ generated by FBC unit 308A. Signal $Y_l$ may differ from signal $Y_{lp}$ because of resampling, audio coding, transmission errors, and other intentional or unintentional alterations of signal $Y_{lp}$. Thus, in some examples, the version of signal $Y_{lp}$ that transceiver 310A transmits to transceiver 310B is not the same as signal $Y_l$.

Similarly, local beamformer 306B receives a microphone signal ($X_{fc}$) from front contra microphone 302B and a microphone signal ($X_{rc}$) from rear contra microphone 304B. Local beamformer 306B combines microphone signal $X_{fc}$ and microphone signal $X_{rc}$ into a signal $Y_{c_fb}$. Local beamformer 306B may generate signal $Y_{c_fb}$ in a manner similar to how local beamformer 306A generates signal $Y_{1_fb}$. The signal $Y_{c_fb}$ is so named because it is a contra signal that may include feedback (fb). Feedback may be present in microphone signals $X_{rc}$ and $X_{rc}$ because front contra microphone 302B and/or rear contra microphone 304B may receive soundwaves generated by receiver 300B and/or receiver 300A. Accordingly, in the example of FIG. 3, FBC unit 308B may use signal $Z_c$ to cancel the feedback in signal $Y_{c_fb}$, resulting in signal $Y_{cp}$. Signal $Y_{cp}$ is so named because it is a contra (c) signal that has been processed (p). This disclosure may refer to signal $Y_{cp}$ as a contra intermediate audio signal when the contra device applies binaural beamforming. Transceiver 310B of ear-wearable device 102B may transmit a version of signal $Y_{cp}$ to transceiver 310A of ear-wearable device 102A.

When binaural beamforming is enabled, adaptive binaural beamformer 314A may generate an output signal $Z_l$ based on signal $Y_{lp}$ and a signal $Y_c$. Signal $Y_c$ is or is based on signal $Y_{cp}$ generated by FBC unit 308B. Signal $Y_c$ may differ from signal $Y_{cp}$ because of resampling, audio coding, transmission errors, and other intentional or unintentional alterations of signal $Y_{cp}$. Thus, in some examples, the version of signal $Y_{cp}$ that transceiver 310B transmits to transceiver 310A is not the same as signal $Y_c$.

When binaural beamforming is disabled, signal $Y_{lp}$ may be the output signal $Z_l$ instead of the signal generated by adaptive binaural beamformer 314A. Similarly, when binaural beamforming is disabled, signal $Y_{cp}$ may be the output signal $Z_c$ instead of the signal generated by adaptive binaural beamformer 314B.

As noted above, adaptive binaural beamformer (ABB) 314A generates an output audio signal $Z_l$. Signal $Z_l$ may be used to drive receiver 300A. In other words, receiver 300A may generate soundwaves based on output audio signal $Z_l$. In accordance with a technique of this disclosure, ABB 314A may calculate signal $Z_l$ as:

$$Z_l = V_l Y_l - \alpha_l (V_l Y_l - V_c Y_c) = Y_{lv} - \alpha_l (Y_{lv} - Y_{cv})$$

$$Z_l = Y_{lv} - \alpha_l Y_{diff}, \text{ where } Y_{diff} = (Y_{lv} - Y_{cv}) \quad (1)$$

In the equations above, $V_l$ and $V_c$ are local and contra correction factors, $\alpha_l$ is a local parameter.

Correction factors $V_l$ and $V_c$ may ensure that target signals (e.g., sound radiated from a single source at the same instant) in the two signals $Y_l$ and $Y_c$ are aligned (e.g., in terms of time, amplitude, etc.). Correction factors $V_l$ and $V_c$ can align differences due to microphone sensitivity (e.g., amplitude and phase), wireless transmission (e.g., amplitude and phase/delay), target position (e.g., in case the target (i.e., the source of a sound that the user wants to listen to) is not positioned immediately in front of the user).

Correction factors $V_l$ and $V_c$ may be set as parameters within devices 102 or estimated online by a remote processor and downloaded to one or both of the devices. For example, a technician or other person may set $V_l$ and $V_c$ when a user of auditory device system 100 is fitted with ear-wearable devices 102. In some examples, $V_l$ and $V_c$ may be determined by ear-wearable devices 102 dynamically. For instance, auditory device system 100 may estimate $V_l$ and $V_c$ by determining values of $V_l$ and $V_c$ that maximize the energy of the signal $V_lY_l+V_cY_c$ while constraining the norm $|V_l|+|V_c|=1$, where $|\cdot|$ indicates the norm operator. In some examples, both $V_l$ and $V_c$ are in unity. In other words, $V_l$ and $V_c$ may have the same value. In other examples, $V_l$ and $V_c$ have different values.

ABB 314A and ABB 314B may be similar to a Generalized Sidelobe Canceller (GSC), as described in Doclo, S. et al "Handbook on array processing and sensor networks," pp. 269-302. To avoid self-cancellation and to maintain spatial impression, the parameter $\alpha_l$ is restricted to be a real parameter between 0 and ½. The value $\alpha_l=0$ corresponds to the bilateral solution and $\alpha_l=½$ corresponds to the static binaural beamformer. The restriction on $\alpha_l$ also limits the self-cancellation. If $\alpha_l=½$ and $Y_{diff}$ is 10 dB below $Y_{lv}$, the self-cancellation is db(1−0.5*0.3)=−1.4 dB. It would be possible to correct for this self-cancellation by scaling $V_l$ and $V_c$. The solution is limited to $\alpha_l<=½$, because solutions with $\alpha_l>½$ correspond to solutions that use the contra-signal more than the $Y_{lv}$ signal and this would result in an odd spatial perception (sources from the left seem to come from the right and vice versa).

Figure 4:
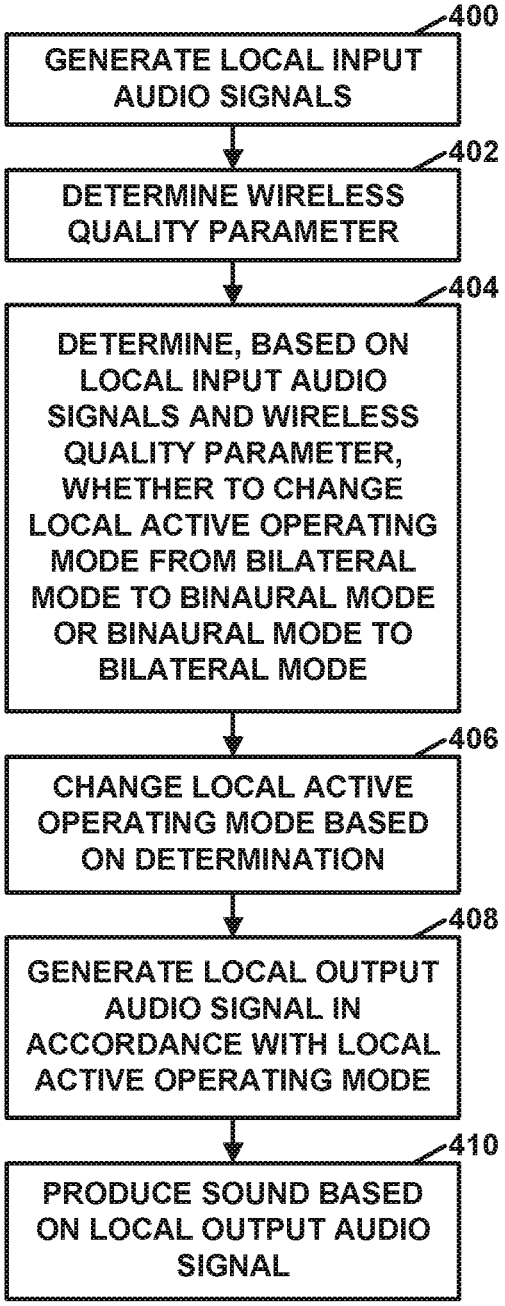
FIG. 4 is a flowchart illustrating an example operation of a local device in accordance with one or more techniques of this disclosure.

FIG. 4 is a flowchart illustrating an example operation of a local device in accordance with one or more techniques of this disclosure. The local device may be either of ear-wearable devices 102 (FIG. 1). Each of ear-wearable devices 102 may perform the operation of FIG. 4 concurrently. Thus, when ear-wearable device 102A is performing the operation of FIG. 4, ear-wearable device 102A is the local device and ear-wearable device 102B is the contra device. When ear-wearable device 102B is performing the operation of FIG. 4, ear-wearable device 102B is the local device and ear-wearable device 102A is the contra device.

In the example of FIG. 4, the local device may generate one or more local input audio signals based on sound detected by one or more microphones (e.g., microphones 208) of the local device (400). For instance, when the local active operating mode of the local device is an omnidirectional bilateral mode, the local device may generate a single local input audio signal based on sound detected by a single one of the local microphones (i.e., the microphones of the local device). When the local active operating mode of the local device is a directional mode (e.g., a bilateral directional mode or a binaural directional mode), the local device may generate two or more local input audio signals based on sound detected by two or more of the local microphones. In some examples, the local device may determine whether to change between an omnidirectional mode and a directional mode based on the one or more local input audio signals.

Additionally, the local device may determine a wireless quality parameter indicative of a current environment for wireless communication with the contra device (402). As described elsewhere in this disclosure, the local device may determine the wireless quality parameter in various ways. For example, the local device may determine the wireless quality parameter as a rate at which bit errors occur during wireless E2E communication.

Figure 12:
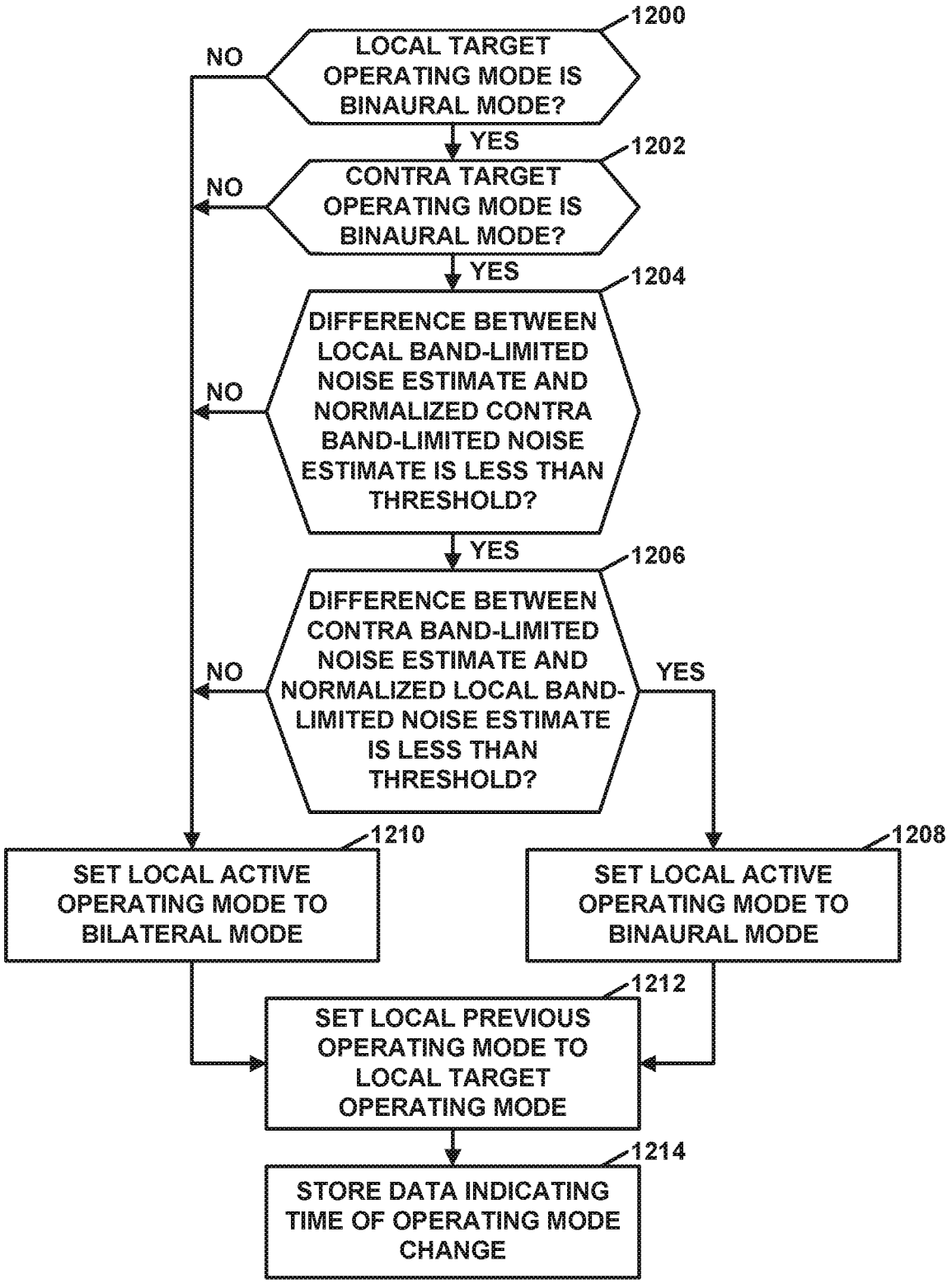
FIG. 12 is a flowchart illustrating an example operation to determine a local active operating mode after an ear-to-ear data exchange in accordance with one or more techniques of this disclosure.
Figure 13:
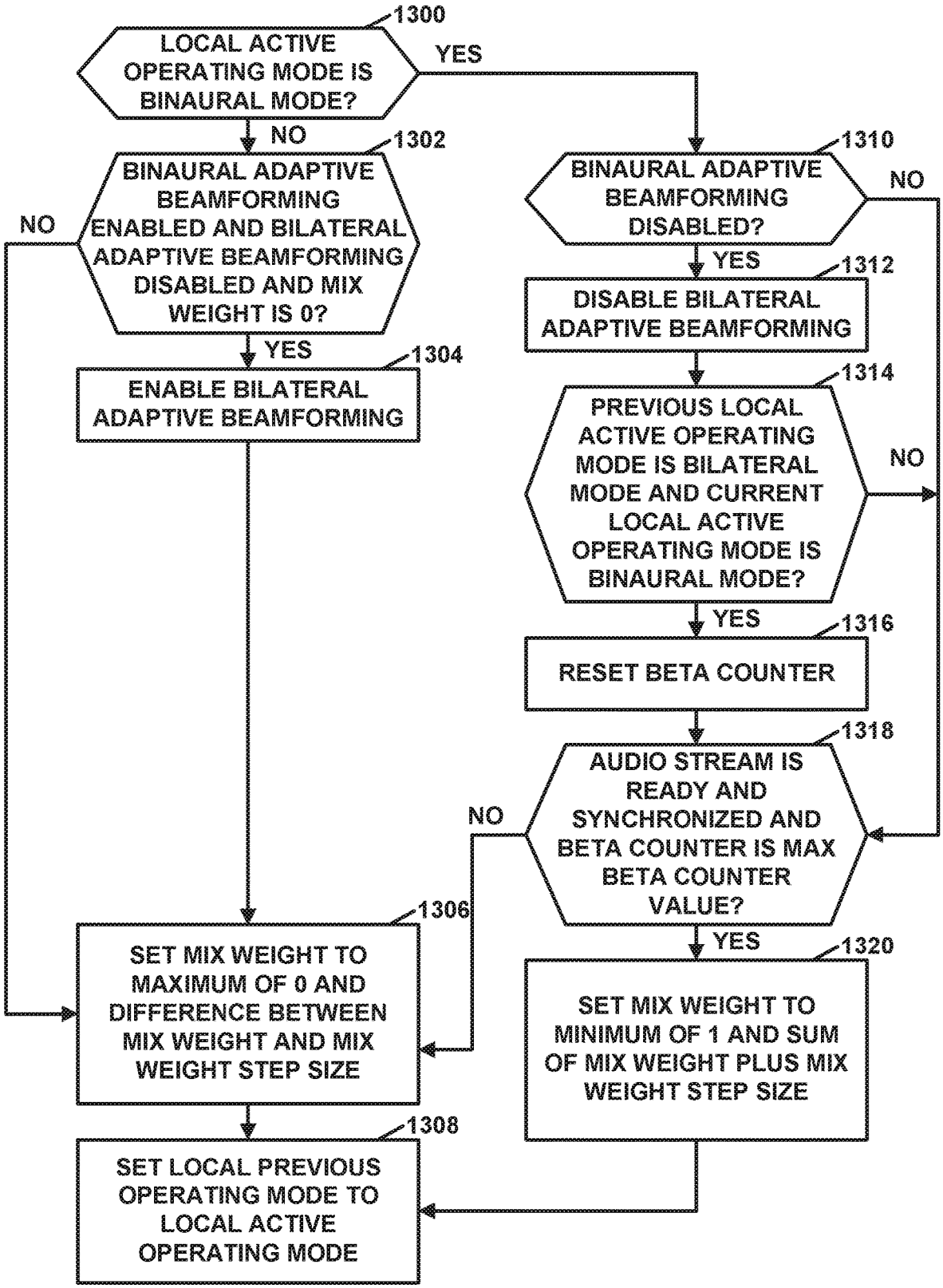
FIG. 13 is a flowchart illustrating an example operation for adaptation depending on the local active operating mode in accordance with one or more techniques of this disclosure.

The local device may determine, based on the one or more local input audio signals and the wireless quality parameter, whether to change a local active operating mode of the local device from a bilateral mode to a binaural mode or from the binaural mode to the bilateral mode (404). The flowcharts shown in FIG. 5 through FIG. 12 are examples of how the local device may determine whether to change the local active operating mode. The local device may change the local active operating mode based on the determination (406). FIG. 13 is an example of how the local device may change the local active operating mode based on the determination. In other examples, the local device may change the local active operating mode in a manner different from that described with respect to FIG. 13.

Furthermore, in the example of FIG. 4, the local device may generate a local output audio signal based on the one or more local input audio signals in accordance with the local active operating mode (408). A receiver of the local device (e.g., receiver 218 (FIG. 2)) may produce sound based on the local output audio signal (410). When the local active operating mode is the binaural mode, the local device wirelessly receives a contra intermediate audio signal from the contra device (e.g., signal $Y_{cp}$ of FIG. 3) and wirelessly transmits a local intermediate audio signal (e.g., signal $Y_{lp}$ of FIG. 3) to the contra device. The local intermediate audio signal is based on the one or more local input audio signals (e.g., signals $X_{fl}$ and $X_{rl}$ of FIG. 3). Additionally, when the local active operating mode is the binaural mode, the local device may generate the local output audio signal (e.g., signal $Z_l$ of FIG. 3) based on the one or more local input audio signals and the contra intermediate audio signal. For instance, the local device may apply binaural beamforming to the local intermediate audio signal and the contra intermediate audio signal as described elsewhere in this disclosure. Similarly, the local device and the contra device may use the local intermediate audio signal and the contra intermediate audio signal for binaural noise reduction. One example of binaural noise reduction is described in the background section above.

When the local active operating mode is the bilateral mode, the local device does not wirelessly receive the contra intermediate audio signal (e.g., signal $Y_{cp}$ of FIG. 3) from the contra device. Rather, when the local active operating mode is the bilateral mode, the local device may generate the local output audio signal based on the one or more local input audio signals without use of the contra intermediate audio signal. For example, when the local active operating mode is an omnidirectional bilateral mode, the local device may modify one of local input audio signals (e.g., signal $X_{fl}$ or $X_{rl}$ of FIG. 3) to generate the local output audio signal (e.g., signal $Z_l$ of FIG. 3). For instance, the local device may increase or decrease amplitudes at particular frequencies in the local input audio signal. When the local active operating mode is a directional bilateral mode, local beamformer 306A of the local device may apply local beamforming to local input audio signals (e.g., signals $X_{fl}$ and $X_{rl}$ of FIG. 3) and FBC unit 308A of the local device may apply feedback cancellation to generate the local output audio signal (e.g., signal $Z_l$ of FIG. 3).

In some examples, the process to switch the local active operation mode may be based on calculations done on a wearer's mobile phone or other mobile device so that a more extensive switching algorithm can be used for the classification. In some examples, the switching algorithm uses information from other hearing aids in the same location at the same time or at a corresponding time in the past to help determine which operating mode to use.

Figure 5:
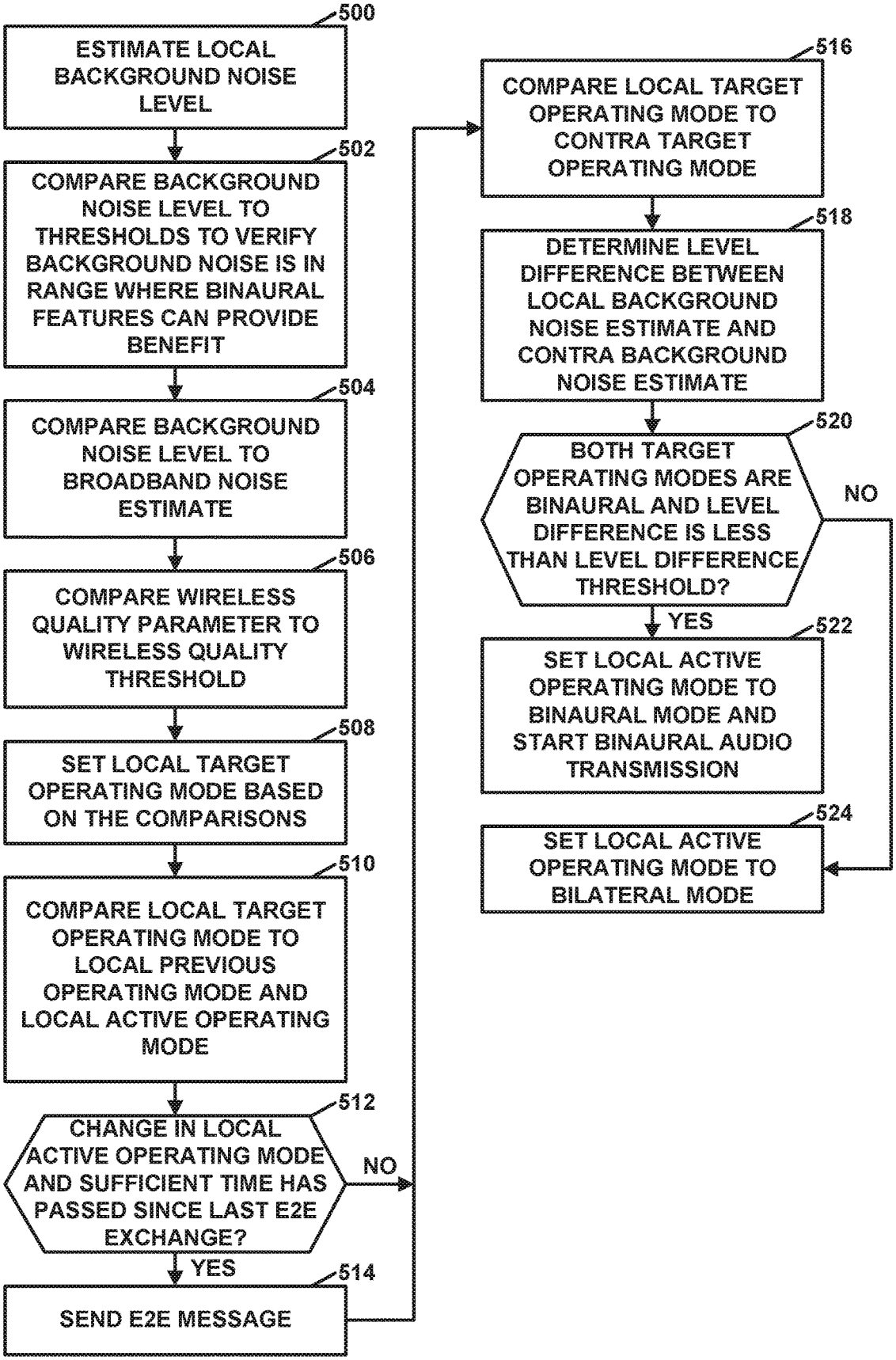
FIG. 5 is a flowchart illustrating an example operation to switch a local active operating mode of a local device in accordance with one or more techniques of this disclosure.

FIG. 5 is a flowchart illustrating an example operation to switch a local active operating mode of a local device in accordance with one or more techniques of this disclosure. Like the example of FIG. 4, each ear-wearable device 102 of auditory device system 100 may perform the operation of FIG. 5 as the local device.

In the example of FIG. 5, the local device estimates a local background noise level (500). This disclosure may refer to the local background noise level as a local band-limited noise estimate or the local noise floor. In some examples, the local background noise level is an estimate of noise in a frequency band between 500 Hz and 2500 Hz, which are the most important for speech. Thus, in some examples, the local background noise level may indicate the sound pressure level (SPL) in decibels (dB) of sound detected by the local microphones (i.e., the microphones of the local device) in the frequency band of 500 Hz to 2500 Hz. In some examples, the local background noise level may be an estimate of noise in a frequency band of 500 Hz to 4000 Hz.

Furthermore, the local device compares the local background noise level to two thresholds to verify that the local background noise level is in a range where binaural features can provide benefit to the wearer (502). For example, noise levels below 68 db sound pressure level (SPL) are typically not intrusive enough to warrant the battery drain associated with binaural audio transmissions associated with the binaural features. In this example, noise levels above 85 dB SPL are typically so loud that speech intelligibility is no longer possible. At noise levels above 85 dB SPL, bilateral noise reduction may be a more efficient solution. Bilateral noise reduction algorithms calculate a frequency-dependent and time-dependent gain that is proportional to the Signal-to-Noise Ratio and applies it to the local microphone signal. An extensive overview of bilateral noise reduction can be found in Loizou, P. C., 2013, *Speech enhancement: theory and practice,* $2^{nd}$ edition, CRC press Additionally, the local device may compare the local background noise level to a local broadband noise estimate (504). The local broadband noise estimate may indicate the SPL of sound detected by the local microphones in a frequency range broader than the frequency range of the local background noise level. For example, the local background noise level may indicate the sound pressure level (SPL) in dBs of sound detected by the local microphones in the frequency range of 500 Hz to 2500 Hz and the local broadband noise estimate may indicate the SPL in dBs of sound detected by the local microphones in the frequency range of 4 Hz to 8 KHz. Comparing the local background noise level to the local broadband noise estimate may help to exclude situations that have a noise spectrum that is very dissimilar to background speech or babble. For example, when a user is driving in a car, the use of a binaural beamformer may be detrimental because the binaural beamformer may remove binaural spatial cues and the use of binaural noise reduction may provide limited benefit because the noise is dominated by low frequencies.

Additionally, in the example of FIG. 5, the local device may compare a value of a wireless quality parameter to a wireless quality threshold to determine whether current environmental conditions are suitable for wireless transmission of audio streams (506). In various examples, the wireless quality parameter may indicate various types of information about the quality (e.g., reliability) of wireless communication between the local device and the contra device. For example, the local device may wirelessly receive data from the contra device. This data may be from other wireless features such as synchronized memory or volume control. In this example, the local device may determine the wireless quality parameter based on an error rate (e.g., a bit error rate (BER)) in the received data. In this example, the wireless quality parameter may be the error rate itself or the local device may derive the wireless quality parameter using the error rate. Other examples include estimates of SNR or related variables in the wireless radio. In this example, the data received from the contra device may include payload data and error detection data (e.g., cyclic redundancy check (CRC) data, parity bits, hash values, etc.) that the local device may use to determine a rate at which bits in the payload data or error detection data were corrupted during wireless transmission from the contra device. If the rate is above the wireless quality threshold, the current environmental conditions for wireless communication between the local device and the contra device may be so unfavorable that it would not be desirable to use binaural features. For instance, in this example, the wireless quality threshold may be $10^{-3}$ errors per bit.

Figure 8:
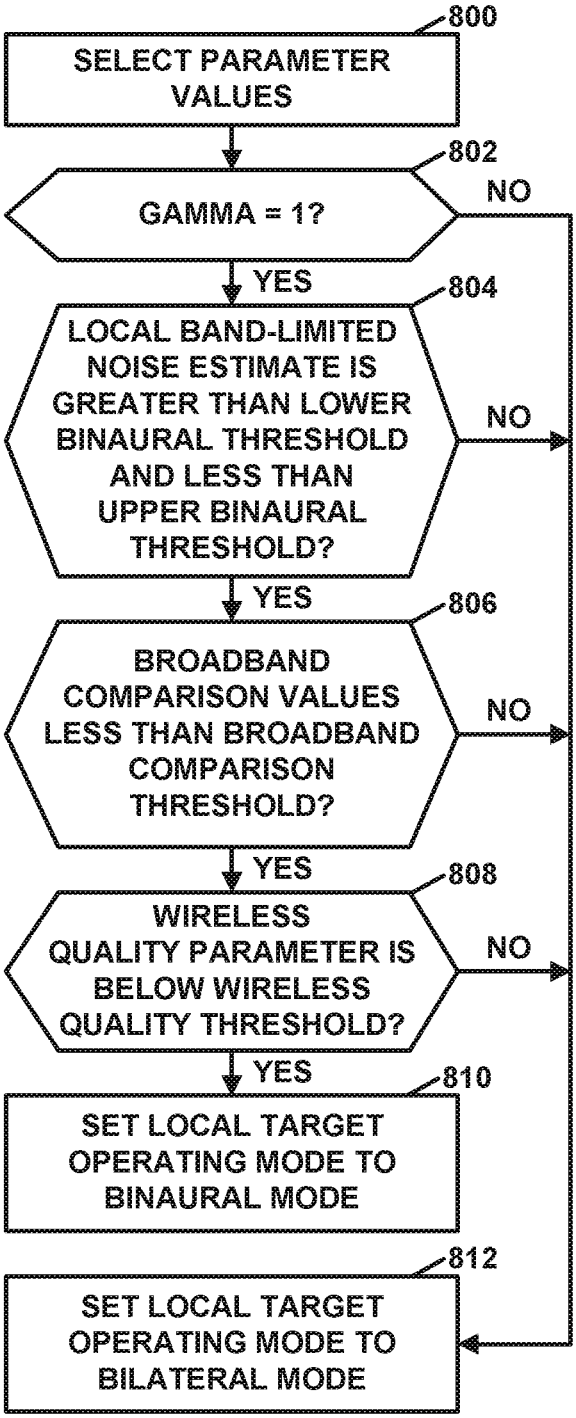
FIG. 8 is a flowchart illustrating an example operation to determine a local target operating mode in accordance with one or more techniques of this disclosure.

Furthermore, in the example of FIG. 5, the local device may set a local target operating mode based on these three comparisons (508). The local target operating mode is not an operating mode that the local device is actually operating in, but rather an operating mode that would be expected to be appropriate given the comparisons described above. FIG. 8, described in detail below, illustrates an example of how the local device may determine the local target operating mode based on these comparisons.

In the example of FIG. 5, the local device may determine whether there is a change in the local active operating mode (i.e., the local target operating mode is different from the local active operating mode) and whether a sufficient amount of time has passed since a last E2E exchange of data between the local device and the contra device (512). If the local device determines that there is a change in the local active operating mode and a sufficient amount of time has passed since the last E2E exchange ("YES" branch of 512), the local device may wirelessly send an E2E message to the contra device (514). The E2E message may specify the local target operating mode, the local active operating mode, the local background noise level, and/or other information. To determine whether a sufficient amount of time has passed since the last E2E exchange, the local device may determine whether a number of frames of audio data occurring since the last E2E exchange is greater than a particular predetermined threshold. A typical value for the threshold is 30 seconds.

Additionally, the local device may compare the local target operating mode to a contra target operating mode (516). The contra device may determine the contra target operating mode in the same way that the local device determines the local target operating mode. The local device may also determine a level difference that indicates a difference between the local background noise level and a contra background noise level (518). Some binaural features, such as binaural beamforming, are only beneficial in a diffuse noise field, such as when there are similar noise levels at the left and right ear.

Accordingly, the local device may determine whether both the local target operating mode and the contra target operating mode are the binaural mode and whether the level difference is less than a level difference threshold (520). A typical value is 2 dB. In response to determining that both the local target operating mode and the contra target operating mode are the binaural mode and the level difference is less than the level difference threshold ("YES" branch of 520), the local device may switch the local active operating mode to the binaural mode and start binaural audio transmission (522). The binaural audio transmission may include the local intermediate audio stream (e.g., signal $Y_{lp}$ of FIG. 3). On the other hand, in response to determining that the local target operating mode and the contra target operating mode are not both the binaural mode or that the level difference is not less than the level difference threshold ("NO" branch of 520), the local device may set the local active operating mode to a bilateral mode (524). For instance, the local device may set the local active operating mode to an omnidirectional bilateral mode or a directional bilateral mode.

Figure 6:
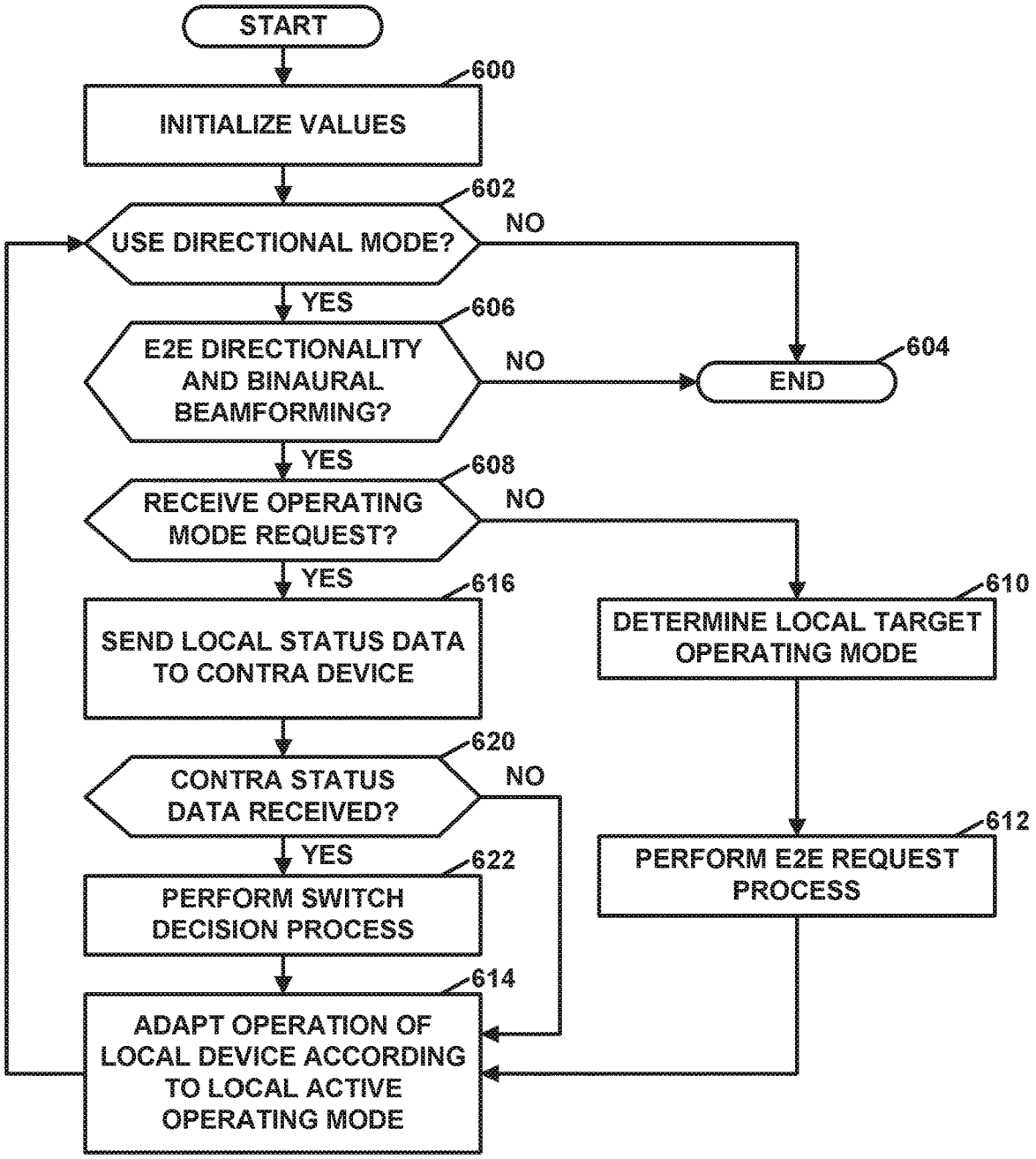
FIG. 6 is a flowchart illustrating an example operation to switch a local active operating mode of a local device in accordance with one or more techniques of this disclosure.

FIG. 6 is a flowchart illustrating an example operation to switch a local active operating mode of a local device in accordance with one or more techniques of this disclosure. FIG. 6 is one example of how the operations of FIG. 4 and FIG. 5 may be implemented.

In the example of FIG. 6, the local device may first initialize one or more values (600). For example, the local device may set a binaural adaptive beamformer enable flag equal to a value of an adaptive beamformer enable flag. The binaural adaptive beamformer enable flag indicates whether binaural adaptive beamforming is enabled in the local device. The adaptive beamformer enable flag indicates whether bilateral adaptive beamforming is enabled in the local device. If bilateral adaptive beamforming is not enabled in the local device, the local active operating mode of the local device may be an omnidirectional bilateral mode.

Additionally, the local device may determine whether the local active operating mode of the local device is to use a directional mode or an omnidirectional mode (602). In a directional mode, the local device may generate input audio streams from multiple local microphones, such as a front microphone and a rear microphone (e.g., microphones 302A and 302B of FIG. 3). In the omnidirectional mode, the local device generates a single input audio stream from a signal microphone (e.g., microphone 302A or microphone 302B of FIG. 3). Use of the omnidirectional mode may be advantageous in quiet conditions when the local background noise level is low (e.g., less than 60 dB). However, when the local background noise level is higher, a directional mode, such as a binaural mode or a bilateral directional mode, may have better results. Hence, in some examples, the local device may make the determination to use the omnidirectional mode in response to determining that the local background noise level is below a threshold (e.g., less than 60 dB) and may make the determination to use a directional mode otherwise.

If the local device makes the determination not to use a directional mode (i.e., the local device makes the determination to use the omnidirectional mode) ("NO" branch of 602), the local device may end the operation of FIG. 6 (604). After the operation ends, the local device may restart operation again on a recurring periodic basis. On the other hand, in response to making a determination to use a directional mode (e.g., a bilateral directional mode or a binaural mode) ("YES" branch of 602), the local device may determine whether E2E directionality is enabled in the local device and whether binaural beamforming is enabled in the local device (606). E2E directionality is a feature that coordinates the bilateral directionality in the hearing aids by exchanging event-based short messages between the ear-wearable devices 102. E2E directionality uses these messages to synchronize the switching between omni and directional mode between the hearing aids. If not ("NO" branch of 606), the local device may end the operation of FIG. 6 (604).

However, in response to determining that E2E directionality is enabled on the local device and that binaural beamforming is enabled on the local device ("YES" branch of 606), the local device may determine whether the local device has received an operating mode request from the contra device (608). The operating mode request is a request for the local device to send data to the contra device that the contra device may use in determining whether to update the contra active operating mode. The operating mode request may also be referred to in this disclosure as the BBF request. In some examples, the received operating mode request may include contra status data, such as one or more of the contra target operating mode, the contra active operating mode, or the contra background noise level. In other examples, the local device may receive the contra status data separately from the operating mode request.

In response to determining that the local device has not received an operating mode request from the contra device ("NO" branch of 608), the local device may determine a local target operating mode (610). In some examples, the local device performs the operation of FIG. 8 to determine the local target operating mode. Additionally, the local device may perform an E2E request process (612). In some examples, the local device performs the operation shown in FIG. 9 to FIG. 11 to perform the E2E request process. In general, as part of performing the E2E request process, the local device sends local status data to the contra device. The local status data may include data indicating one or more of the local target operating mode, the local active operating mode, or the local background noise level. Additionally, as part of performing the E2E request process, the local device may send an operating mode request to the contra device and may receive contra status data from the contra device. The contra status data may include data indicating one or more of the contra target operating mode, the contra active operating mode, and the contra background noise level. After performing the E2E request process, the local device may adapt operation of the local device according to the local active operating mode (614). In some examples, the local device may perform the operation of FIG. 12 to adapt the operation of the local device according to the local active operating mode.

In response to determining that the local device has received an operating mode request ("YES" branch of 608), the local device may send local status data to the contra device (616). The local status data may include data indicating one or more of the local target operating mode, the local active operating mode, or the local background noise level.

If the local device successfully receives the contra status data from the contra device ("YES" branch of 620), the local device may perform a switch decision process (622). By performing the switch decision process, the local device may determine whether to switch the local active operating mode. In some examples, the local device performs the operation of FIG. 12 to perform the switch decision process After performing the switch decision process or in response to determining that the local device did not receive the contra status data from the contra device ("NO" branch of 620), the local device may adapt operation of the local device according to the local active operating mode, which may or may not have changed (614). In some examples, the local device performs the operation of FIG. 12 to adapt the operation of the local device according to the local active operating mode.

After adapting operation of the local device according to the local active operating mode, the local device may loop back and again determine whether to use a directional mode (602), and the process of FIG. 6 may recur. In this way, the local device may complete an iteration of the operation of FIG. 6.

Figure 7:
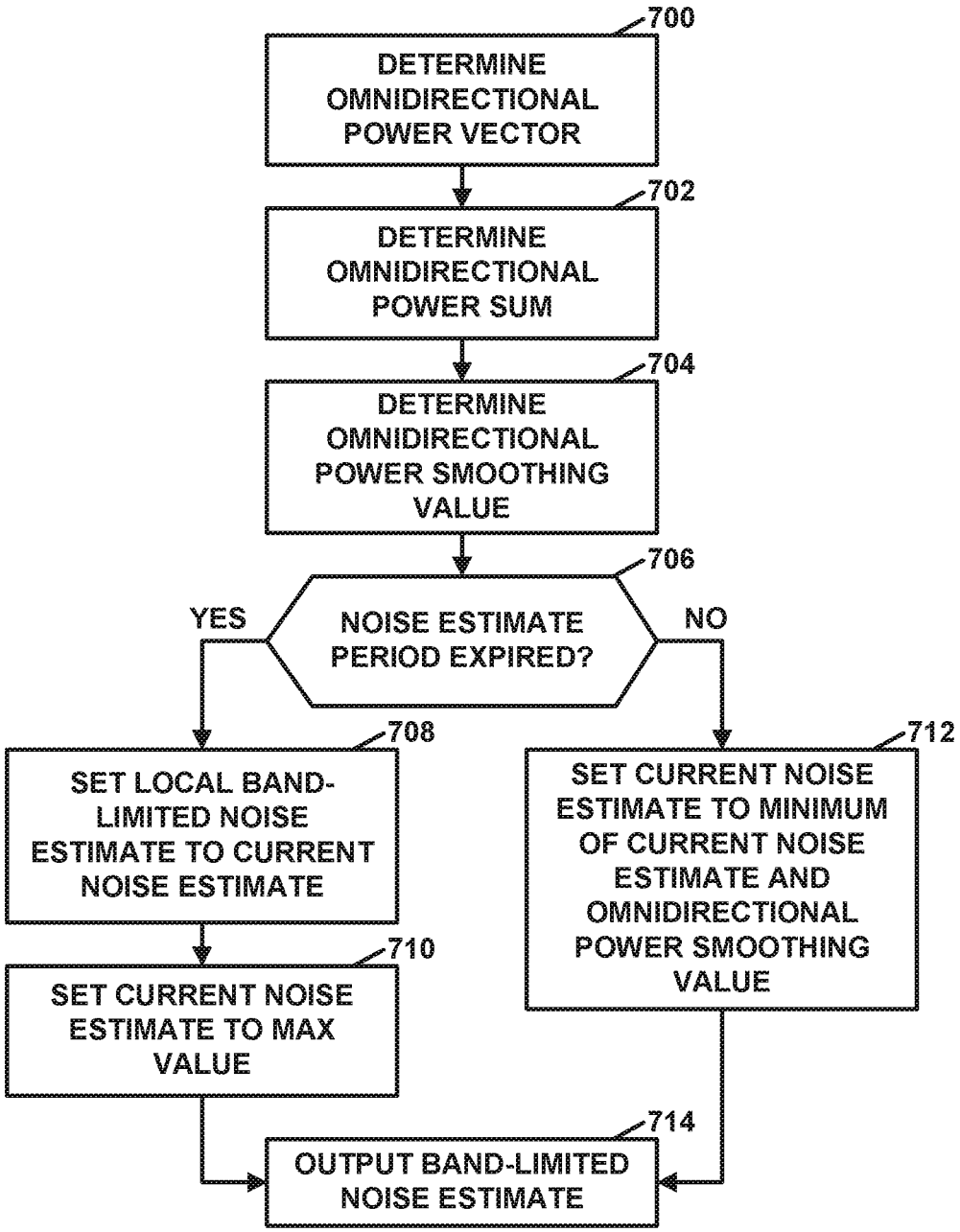
FIG. 7 is a flowchart illustrating an example operation to determine a local band-limited noise estimate in accordance with one or more techniques of this disclosure.

FIG. 7 is a flowchart illustrating an example operation to determine a local band-limited noise estimate in accordance with one or more techniques of this disclosure. In the example of FIG. 7, the local device may determine an omnidirectional power vector (700). In one example, to determine the omnidirectional power vector, the local device may first apply a weighted overlap-add (WOLA) filter bank to a segment of the local input audio signal used for the omnidirectional mode. The resulting vector is denoted "omniWOLA" in this disclosure. In one nonlimiting example, omniWOLA consists of 16 complex values. Each value in omniWOLA may correspond to a different frequency band. In this example, the local device may determine the omnidirectional power vector as the multiplication product of omniWOLA and the conjugate of omniWOLA.

Additionally, the local device may determine an omnidirectional power sum (702). The omnidirectional power sum is the sum of the values in the omnidirectional power vector. Next, the local device may determine an omnidirectional power smoothing value (704). For instance, the local device may determine the omnidirectional power smoothing value based on a previous omnidirectional power smoothing value as follows:

```
omniPowerSmooth=omniPowerSmooth+powerS-
    moothCoef*(omniPowerSum−omniPowerS-
    mooth)
```

In the equation above, omniPowerSmooth is the omnidirectional power smoothing value, powerSmoothCoef is a coefficient that controls the smoothing time constant, and omniPowerSum is the omnidirectional power sum determined in (702).

Furthermore, in the example of FIG. 7, the local device may determine whether a noise estimate period has expired (706). In some examples, the local device uses a timer to determine whether the noise estimate period has expired. In another example, the local device maintains a block counter that indicates how many time-blocks have elapsed. In this example, the local device may perform a modulo operation with respect to the time-block counter and a noise estimate period value. In this example, the noise estimate period value indicates how many time-blocks are in the noise estimate period. In other words, the local device may calculate blockCounter % noiseEstimatePeriod, where blockCounter is the block counter and noiseEstimatePeriod is the noise estimate period value. The local device may then determine whether the resulting value is equal to 0. In this example, the local device may determine that the noise estimate period has expired when the resulting value is equal to 0.

On the other hand, in response to determining that the noise estimate period has expired ("YES" branch of 706), the local device may set the local band-limited noise estimate (i.e., the local background noise level) to a current noise estimate (708). The local device may then set the current noise estimate to a maximum value (710). This maximum value is the maximum value that can happen in the system and it depends on the number of bands and the windowing functions. A typical value is the product of the maximum value of the time-domain signal and the FFT-size On the other hand, in response to determining that the noise estimate period has not expired ("NO" branch of 706), the local device may set the current noise estimate to a minimum of the current noise estimate and the omnidirectional power smoothing value (712). In other words, the local device may set the current noise estimate as:

```
noiseEstimateCurrent=MIN(noiseEstimateCurrent,
    omniPowerSmooth)
```

In the equation above, noiseEstimateCurrent is the current noise estimate and omniPowerSmooth is the omnidirectional power smoothing value.

After setting the current noise estimate in either (708) or (712), the local device outputs the band-limited noise estimate (714).

FIG. 8 is a flowchart illustrating an example operation to determine a local target operating mode in accordance with one or more techniques of this disclosure. In the example of FIG. 8, the local device may select parameter values (800). For example, parameter values of the local device may set as follows by retrieving the parameter values from vectors of values:

```
curBBFThreshold=BBFThreshold[cur-
    rentBBFMode==1]

curBBFLoudThreshold=BBFloudThreshold[cur-
    rentBBFMode=1]

curBBFbandVsBroadDifference=BBFbandVsBroadDifference
    [currentBBFMode==1]

curBBFILD=BBFILD[currentBBFMode=1]
```

In the equations above, curBBFThreshold indicates a lower binaural threshold, curBBFLoudThreshold indicates an upper binaural threshold, curBBFbandVsBroadDifference indicates a broadband comparison threshold, and curBBFILD indicates the level difference between the hearing aids.

Additionally, the local device may determine whether gamma is equal to 1 (802). Gamma is a parameter that indicates the state of the local directional system. If gamma is 0, the local directional system is set to omni. If gamma is 1, the local directional system is set to directional. Binaural switching only happens when the local system is directional. In response to determining that gamma is equal to 1 ("YES" branch of 802), the local device may determine whether the local band-limited noise estimate is greater than the lower binaural threshold and less than the upper binaural threshold (804). In some examples, the lower binaural threshold is 68 dB and the upper binaural threshold is 80 dB.

In response to determining that the local band-limited noise estimate is greater than the lower binaural threshold and less than the upper binaural threshold ("YES" branch of 804), the local device may determine whether one or more broadband comparison values are less than a broadband comparison threshold (806). In one example, the local device may determine a first broadband comparison value as:

```
noiseEstimateBand−
    noiseEstimateBroad*bandVsBroadRatio*
    curBBFbandVsBroadDifference
```

In this example, the local device may determine a second broadband comparison value as:

```
noiseEstimateBroad*bandVsBroadRatio−
    noiseEstimateBand*curBBFbandVs- BroadDif-
    ference
```

In this example, noiseEstimateBand is the local band-limited noise estimate, noiseEstimateBroad is the local broadband noise estimate, bandVsBroadRatio is the ratio of the local band-limited noise estimate to the local broadband noise estimate (e.g., noiseEstimateBand+noiseEstimateBroad), and curBBFbandVsBroadDifference is the difference between the local band-limited noise estimate and the local broadband noise estimate (e.g., noiseEstimateBand−noiseEstimateBroad). In this example, the broadband comparison threshold may be equal to 0.

In response to determining that the broadband comparison values are less than the broadband comparison threshold ("YES" branch of 806), the local device may determine whether a value of a wireless quality parameter is below a wireless quality threshold (808). For example, the local device may determine whether a bit error rate is below a particular threshold (e.g., $10^{-6}$ errors per bit).

Furthermore, in response to determining that the value of the wireless quality parameter is below the wireless quality threshold ("YES" branch of 808), the local device may set the local target operating mode to the binaural mode (810). However, in response to determining that gamma is not equal to 1 ("NO" branch of 802), that the local band-limited noise estimate is less than the lower binaural threshold or greater than the upper binaural threshold ("NO" branch of 804), that the broadband comparison values are not less than the broadband comparison threshold ("NO" branch of 806), or that the value of the wireless quality parameter is not below the wireless quality threshold ("NO" branch of 808), the local device may set the local target operating mode to a bilateral mode (812). For example, if the local band-limited noise estimate is in a range of 60-68 dBs, the local device may set the local target operating mode to a bilateral directional mode in which each of ear-wearable devices 102 uses two microphones, but there is no E2E communication of audio signals. In this example, if the local band-limited noise estimate is greater than the upper binaural threshold, the local device may set the local target operating mode to a bilateral directional high-volume mode.

In some examples, hysteresis is built into the thresholds, such as one or more of the lower binaural threshold or the upper binaural threshold. Thus, in the case of the lower binaural threshold and the upper binaural threshold, the local device may use a higher version of the threshold when the current local target operating mode is associated with a lower noise level and may use a lower version of the threshold when the current local target operating mode is associated with a higher noise level. For example, the lower binaural threshold may be 60 dBs, but if the current local operating mode is a binaural mode, the local device may only set the local target operating mode to a bilateral low-volume mode if the local band-limited noise estimate is less than 57 dBs; if the current operating mode is the bilateral low volume mode, the local device may only set the local target operating mode to the binaural mode if the local band-limited noise estimate is greater than 63 dBs.

Thus, in the example of FIG. 8, the local device may, as part of determining the local target operating mode, determine the local target operating mode based on a first comparison, a second comparison, and a third comparison. The first comparison compares the local background noise level to a first threshold and a second threshold. The second comparison compares a difference between the local background noise level and the local broadband noise level to a third threshold. The third comparison compares the value of the wireless quality parameter to a fourth threshold. For instance, the local device may determine that the local target operating mode is the binaural mode based on the local background noise being greater than the first threshold and less than the second threshold, the difference between the local background noise level and the local broadband noise level being less than the third threshold, and the value of the wireless quality parameter being less than the fourth threshold.

Figure 9:
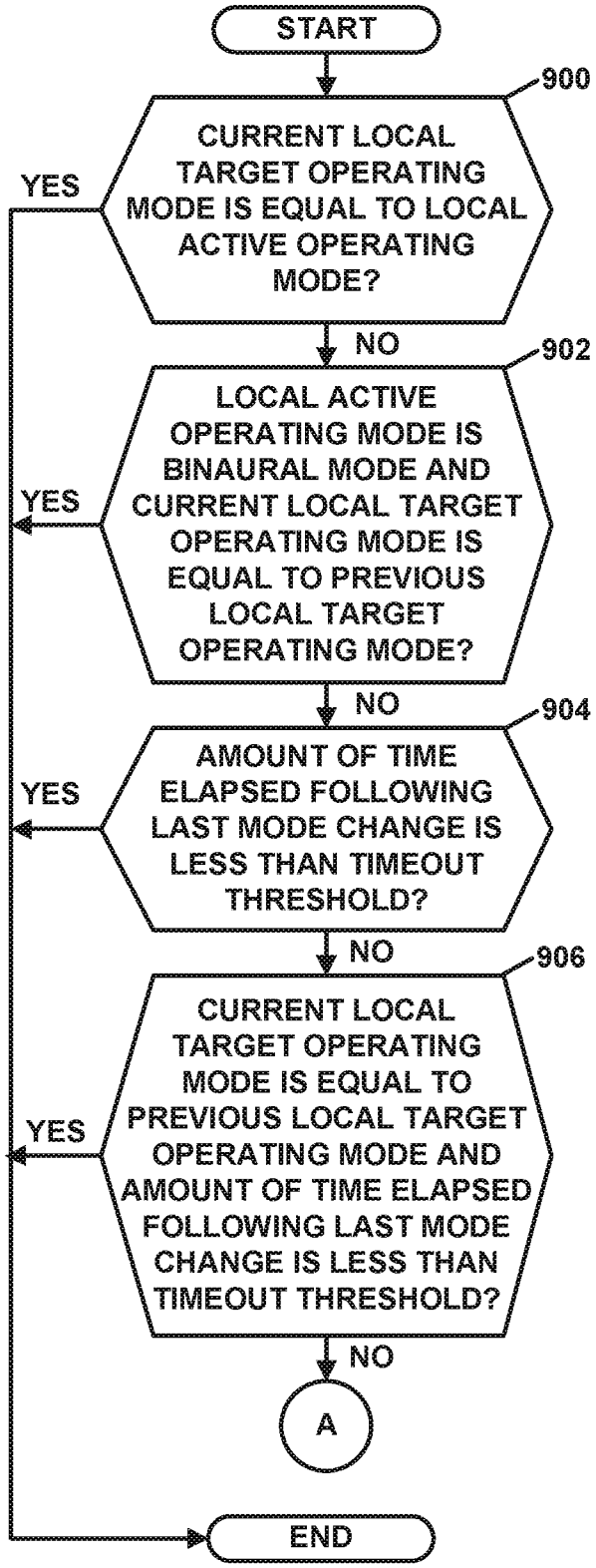
FIG. 9 is a flowchart illustrating a first part of an example operation to determine whether to initiate ear-to-ear communication in accordance with one or more techniques of this disclosure.

FIG. 9 is a flowchart illustrating a first part of an example operation to determine whether to initiate ear-to-ear communication in accordance with one or more techniques of this disclosure. In the example of FIG. 9, the local device first determines whether the local target operating mode is equal to the local active operating mode (900). In response to determining that the local target operating mode is not equal to the local active operating mode ("NO" branch of 900), the local device may determine whether the local active operating mode is the binaural mode and whether the current local target operating mode is equal to the previous local target operating mode (902). The previous local target operating mode is the local target operating mode at the time of the previous E2E exchange.

In response to determining that the current local active operating mode is the binaural mode and the current local target operating mode is not equal to the previous local target operating mode ("NO" branch of 902), the local device may determine whether an amount of time elapsed following a last mode change is less than a timeout threshold (904). In response to determining that the amount of time elapsed following the last mode change is not less than the timeout threshold ("NO" branch of 904), the local device may determine whether the current local target operating mode is equal to the previous local target operating mode and an amount of time elapsed following the last mode change is less than the timeout threshold (906). In response to determining that the current local target operating mode is not equal to the previous local target operating mode or the amount of time elapsed following the last mode change is not less than the timeout threshold ("NO" branch of 906), the local device may perform the part of the operation shown in FIG. 10, starting from the location marked as "A." In this way, the local device may wirelessly transmit the local status data to the contra device when the local active operating mode is different from the local target operating mode and a sufficient amount of time has passed following a most recent time the local device wirelessly transmitted the local status data to the contra device.

Otherwise, in response to determining that the current local target operating mode is equal to the current local active operating mode ("YES" branch of 900), the current local active operating mode is the binaural mode and the current local target operating mode is equal to the previous local target operating mode ("YES" branch of 902), the amount of time elapsed following the last mode change is less than the timeout threshold ("YES" branch of 904), or the current local target operating mode is equal to the previous local target operating mode and the amount of time elapsed following the last mode change is less than the timeout threshold ("YES" branch of 906), the operation of FIG. 9 may end without the local device initiating E2E communication.

Figure 10:
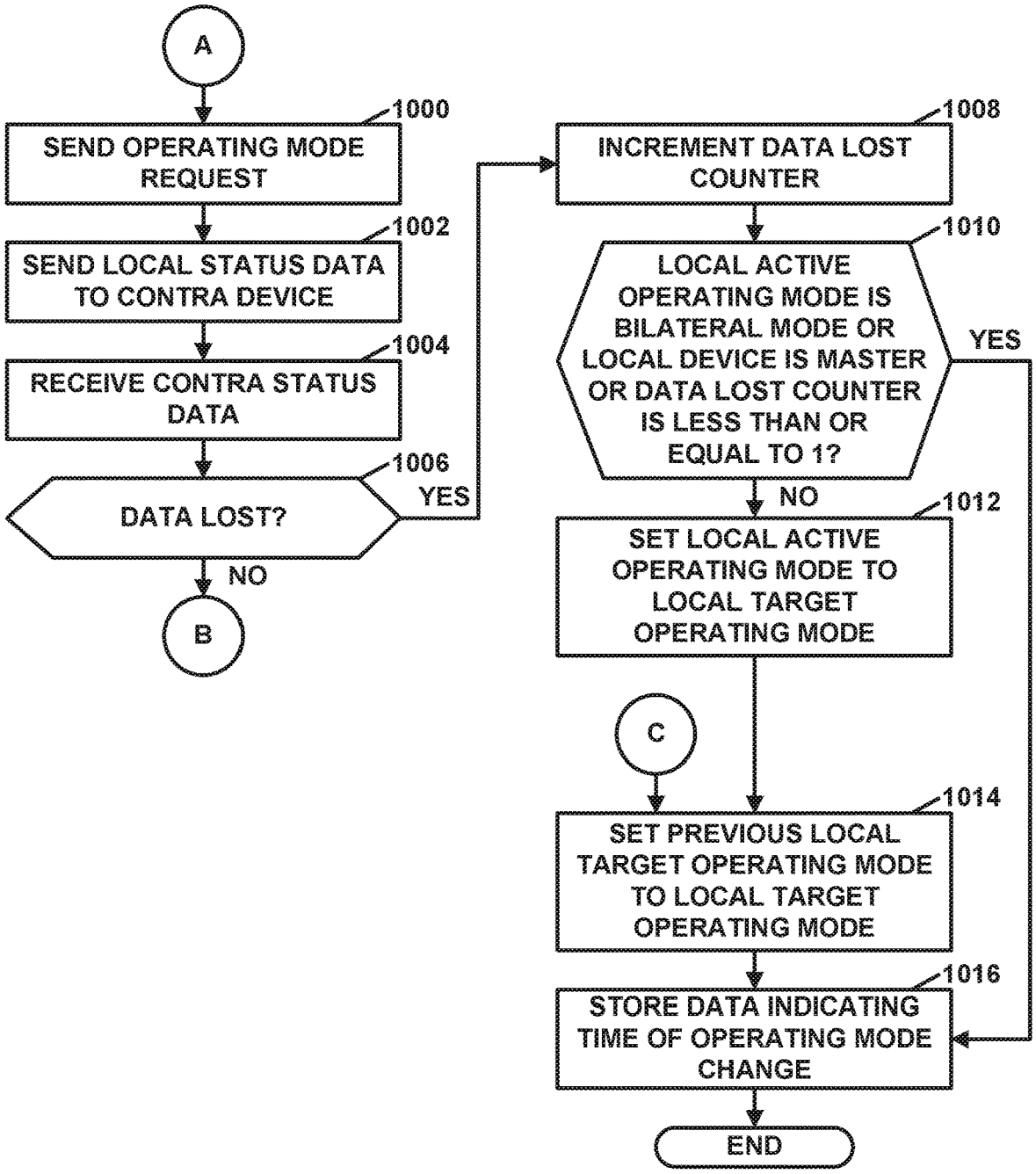
FIG. 10 is a flowchart illustrating a second part of the example operation of FIG. 9.

FIG. 10 is a flowchart illustrating a second part of the example operation of FIG. 9. In the example of FIG. 10, the local device may send an operating mode request to the contra device (1000). The operating mode request may indicate to the contra device that the contra device is to send contra status data to the local device.

Furthermore, in the example of FIG. 10, the local device may send local status data to the contra device data (1002). The local status data may include data indicating the local target operating mode, the local active operating mode, and the local band-limited noise estimate. Additionally, the local receive may receive contra status data from the contra device (1004). The contra status data may include data indicating the contra target operating mode, the contra active operating mode, and the contra band-limited noise estimate.

The local device may determine whether data was lost during transmission of the either the local status data or the contra status data (1006). The lost data can be not receiving a package after transmission of a package or the reception of an incomplete package. In response to determining that no data was lost ("NO" branch of 1006), the local device may perform the part of the operation shown in FIG. 11, starting from the point marked as "B."

On the other hand, in response to determining that data was lost ("YES" branch of 1006), the local device may increment a data lost counter (1008). Furthermore, the local device may determine whether the local active operating mode is a bilateral mode or the local device is a master or the data lost counter is less than or equal to 1 (1010). When a device is the master device, the device initiates and controls the bidirectional audio transfer. The master device transmits audio packets at a regular interval. The non-master device only transmits an audio packet on receival of an audio packet. In response to determining that the local active operating mode is not a bilateral mode and the local device is not the master and the data lost counter is not less than or equal to 1 ("NO" branch of 1010), the local device may set the current local active operating mode to the local target operating mode (1012). Additionally, the local device may set the previous local target operating mode to the local target operating mode (1014). The local device may also store data indicating a time of the last operating mode request (1016). For example, the local device may reset a counter that indicates a number of frames since the last operating mode request change to 0. The process may then end.

In response to determining that the current local active operating mode is a bilateral mode, the local device is master, or the data lost counter is less than or equal to 1 ("YES" branch of 1010), the local device may store the data indicating the time of operating mode change (1016) and the process may then end.

Figure 11:
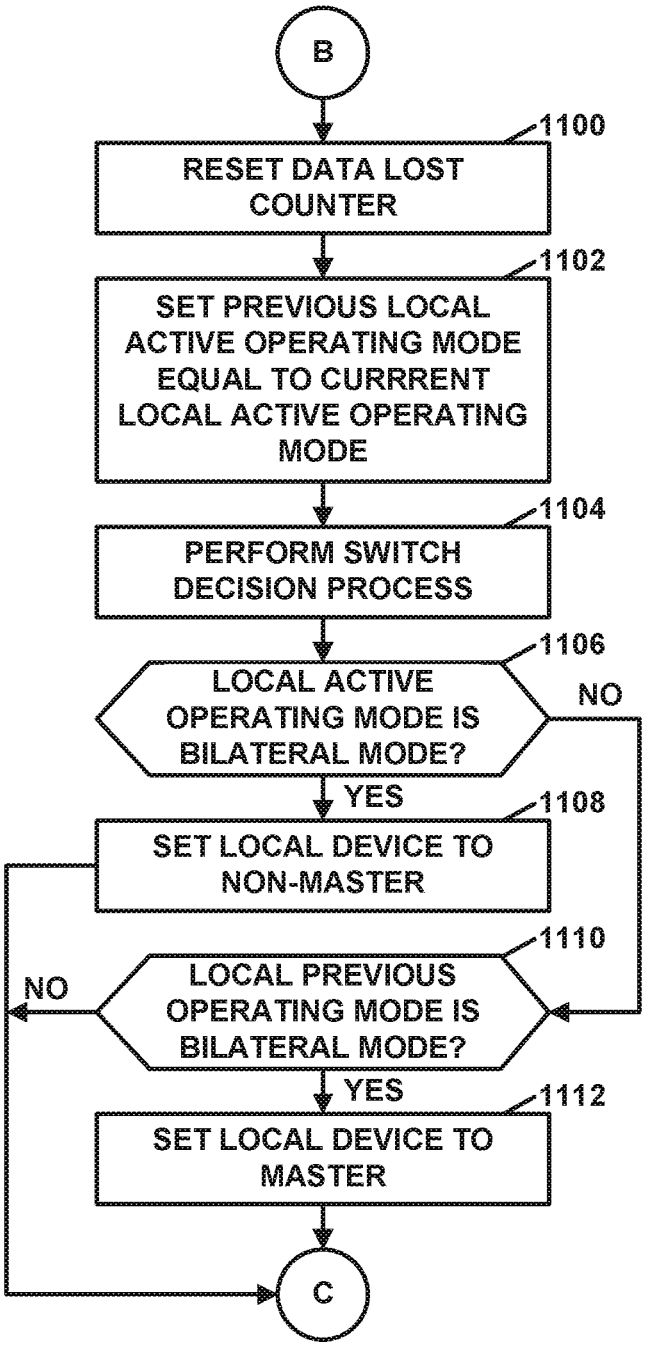
FIG. 11 is a flowchart illustrating a third part of the example operation of FIG. 9.

FIG. 11 is a flowchart illustrating a third part of the example operation of FIG. 9. In the example of FIG. 11, the local device resets the data lost counter to 0 (1100). Additionally, the local device may set the previous local active operating mode equal to the current local active operating mode (1102). Furthermore, the local device may perform the switch decision process (1104). FIG. 12 is an example of the switch decision process.

Next, the local device may determine whether the local active operating mode is a bilateral mode (1106). In response to determining that the local active operating mode is the bilateral mode ("YES" branch of 1106), the local device may set the local device to be a non-master device (1108) and the local device may perform a portion of the operation starting at position "C" of FIG. 10.

On the other hand, in response to determining that the local active operating mode is not the bilateral mode ("NO" branch of 1106), the local device may determine whether the previous local active operating mode is the bilateral mode (1110). In response to determining that the local previous operating mode is not the bilateral mode ("NO" branch of 1110), the local device may perform a portion of the operation starting at position "C" of FIG. 10. However, in response to determining that the local previous operating mode is the bilateral mode ("YES" branch of 1110), the local device may set the local device to be a master device (1112) and the local device may perform a portion of the operation starting at position "C" of FIG. 10.

In this way, as part of determining whether to change the local active operating mode, the local device estimates a local background noise level based on the one or more local input audio signals. Additionally, the local device may estimate a local broadband noise level. The local broadband noise level may be an estimate of a noise level in a frequency band broader than a frequency band of the local background noise level. In some examples, the local broadband noise level is an estimate of a noise level in a frequency band that includes typical human voice sounds (e.g., the local broadband noise level may be an estimate of a noise level in a band of 100 Hz to 8 KHz and typical human voice sounds are in a frequency band from 85 Hz to 8 kHz). In some examples, the local broadband noise level is an estimate of a noise level in a frequency band of 0 kHz to 8 kHz or 10 kHz. Furthermore, the local device may determine a local target operating mode based on the local background noise level, the local broadband noise level, and the wireless quality parameter. In this example, the local target operating mode may be either the bilateral mode or the binaural mode. Furthermore, the local device may wirelessly receive contra status data from the contra device. The contra status data may indicate a contra target operating mode and a contra background noise level. The contra target operating mode is a target operating mode as determined by the contra device. The contra background noise level is a level of background noise as estimated by the contra device. Furthermore, in this example, the local device may wirelessly transmit local status data to the contra device. The local status data may indicate the local target operating mode and the local background noise level. The local device may make the determination to change the local active operating mode from the bilateral mode to the binaural mode in response to determining that the local target operating mode and the contra target operating mode are the binaural mode and a difference between the local background noise level and the contra background noise level is less than a noise level difference threshold. The local device may make the determination to change the local active operating mode from the binaural mode to the bilateral mode in response to determining that either of the local target operating mode and the contra target operating mode is the bilateral mode.

In the example flowcharts of FIG. 9, FIG. 10 and FIG. 11, when the local device and the contra device are in the bilateral mode, the ear-wearable device that initiates the operating mode request may be the master during the binaural mode because streaming may commence only once both ear-wearable devices have exchanged and received information. When the ear-wearable devices are in the binaural mode, the local device repeats the E2E message until a response has been received. When the ear-wearable devices are in the binaural mode and the non-master device sends an E2E request to go out of the binaural mode, and the non-master device does not receive a response, the non-master device does not receive a subsequent response because the master device would have gone out of the binaural mode already. In this case, the non-master device may count the number of E2E messages that were not responded to and go out of the binaural mode itself if the non-master device has not received responses to a given number of E2E messages (e.g., 2 E2E messages). Furthermore, in some versions of the examples of FIG. 9, FIG. 10 and FIG. 11, the local device may update the previous local target operating mode only after a successful E2E exchange. In some examples, the previous local target operating mode and the data indicating the time of the last operating mode change are reset as part of the process to determine whether to change the operating mode and the resetting steps for these values in FIG. 9 to FIG. 11 may be omitted.

The following table indicates whether to send an E2E message given the local active operating mode, the local target operating mode, and the previous local active operating mode.

| Active operating mode | Target operating mode | Previous target operating mode | Send E2E message? | ! ((target operating mode == current operating mode) \|\| (current operating mode == 1 && target operating mode == previous active operating mode)) |
|---|---|---|---|---|
| 0 | 0 | 0 | 0 | 0 |
| 0 | 0 | 1 | 0 | 0 |
| 0 | 1 | 1 | 1 (with long time-out) | 1 |
| 1 | 0 | 0 | 0 (NA) | 0 |
| 1 | 0 | 1 | 1 | 1 |
| 1 | 1 | 0 | 0 (NA) | 0 |
| 1 | 1 | 1 | 0 | 0 |

FIG. 12 is a flowchart illustrating an example operation to determine a local active operating mode after an ear-to-ear data exchange in accordance with one or more techniques of this disclosure. In accordance with the flowchart of FIG. 12, the local device determines whether the local device is in a bilateral mode or a binaural mode. The local device will be in the binaural mode if both the local target operating mode and the contra target operating mode are the binaural mode and if a difference between the local and contra band-limited noise estimates (i.e., noiseEstimateBand and contraNoiseEstimateBand) is within a threshold. The noise estimates may be in the power domain.

In the example of FIG. 12, the local device determines whether the local target operating mode is the binaural mode (1200). In response to determining that the local target operating mode is the binaural mode ("YES" branch of 1200), the local device determines whether the contra target operating mode is the binaural mode (1202). In response to determining that the local target operating mode is binaural mode ("YES" branch of 1200) and in response to determining that the contra target operating mode is binaural mode ("YES" branch of 1202), the local device may determine whether a difference between the local band-limited noise estimate and normalized contra band-limited noise estimate is less than a threshold (1204). The local device may determine the normalized contra band-limited noise estimate as curBBFILD*contraNoiseEstimateBand. As noted above, curBBFILD indicates the difference in level between the ear-wearable devices and contraNoiseEstimateBand indicates the contra band-limited noise estimate. In some examples, the threshold is equal to 0.

In response to determining that the difference between the local band-limited noise estimate and the normalized contra band-limited noise estimate is less than the threshold ("YES" branch of 1204), the local device may determine whether a difference between the contra band-limited noise estimate and a normalized local band-limited noise estimate is less than the threshold (1206). The local device may determine the normalized local band-limited noise estimate as curBBFILD*localNoiseEstimateBand. In response to determining that the difference between the contra band-limited noise estimate and the normalized local band-limited noise estimate is less than the threshold ("YES" branch of 1206), the local device may set the current local active operating mode to the binaural mode (1208).

In response to determining that the local target operating mode is not the binaural mode ("NO" branch of 1200), in response to determining that the contra target operating mode is not the binaural mode ("NO" branch of 1202), in response to determining that the difference between the local band-limited noise estimate and the normalized contra band-limited noise estimate is not less than the threshold ("NO" branch of 1204), or in response to determining that the difference between the contra band-limited noise estimate and the normalized local band-limited noise estimate is not less than the threshold ("NO" branch of 1206), the local device may set the current local active operating mode to the bilateral mode (1210).

In either case, the local device may set the local previous operating mode to the local target operating mode (1212) and may store data indicating a time of operating mode change (1214).

FIG. 13 is a flowchart illustrating an example operation for adaptation depending on the local active operating mode in accordance with one or more techniques of this disclosure. In the example of FIG. 13, the local device may determine whether a local active operating mode is the binaural mode (1300). In response to determining that the local active operating mode is not the binaural mode ("NO" branch of 1300), the local device may determine whether binaural adaptive beamforming is enabled, whether bilateral adaptive beamforming is disabled, and whether a mix weight is equal to 0 (1302). In some examples, the mix weight is limited a range from 0 and 1. In response to determining that binaural adaptive beamforming is enabled and bilateral adaptive beamforming is disabled and the mix weight is equal to 0 ("YES" branch of 1302), the local device may enable bilateral adaptive beamforming (1304). Subsequently, or in response to determining that binaural adaptive beamforming is not enabled or bilateral adaptive beamforming is not disabled or the mix weight is not equal to 0 ("NO" branch of 1302), the local device may set the mix weight to a maximum of 0 and a difference between the mix weight and a mix weight step size (1306). The local device may also set the local previous operating mode to the local active operating mode (1308).

In response to determining that the local active operating mode is the binaural mode ("YES" branch of 1300), the local device may determine whether binaural adaptive beamforming is disabled (1310). In response to determining that binaural adaptive beamforming is disabled ("YES" branch of 1310), the local device may disable bilateral adaptive beamforming (1312). Additionally, the local device may determine whether the local previous operating mode is the bilateral mode and the local active operating mode is the binaural mode (1314). In response to determining that the local previous operating mode is the bilateral mode and the local active operating mode is the binaural mode ("YES" branch of 1314), the local device may reset a beta counter (1316). For instance, the local device may reset the beta counter to 0. The beta counter controls the mixing between the local and contra signals. In one example, in the first instance that the local device switches the local active operating mode from the bilateral mode to the binaural mode, the local device resets the beta counter to 0. In this example, this may cause an adaptive filter coefficient in an Elko Pong algorithm to be smoothed toward betaInit. This may ensure that both of the ear-wearable devices use the same bilateral directional setting.

After resetting the beta counter, or in response to determining that binaural adaptive beamforming is not disabled ("NO" branch of 1310), or in response to determining that the local previous operating mode is not the bilateral mode or the local active operating mode is not the binaural mode ("NO" branch of 1314), the local device may determine whether an audio stream is ready and synchronized and whether the beta counter is a maximum beta counter value (1318). The local device may determine that the audio stream is ready and synchronized by the reception of audio packets and the convergence of a synchronization algorithm. By determining whether the maximum beta counter value is the maximum beta counter value, the local device may determine whether the switching to the binaural beamformer is complete. In response to determining that the audio stream is not ready and synchronized or the beta counter is not the maximum beta counter value ("NO" branch of 1318), the local device may perform actions (1306) and (1308) as previously described. However, in response to determining that the audio stream is ready and synchronized and the beta counter is equal to the maximum beta counter value ("YES" branch of 1318), the local device may set the mix weight to a minimum of 1 and a sum of the mix weight plus the mix weight step size (1320). The local device may use the mix weight as described below with respect to FIG. 14. The local device may then set the local previous operating mode to the local active operating mode (1308). In some examples, after a transition out of the binaural mode to the bilateral mode, the local device does not re-enable the binaural adaptive beamformer until the mix weight is equal to 0.

Figure 14:
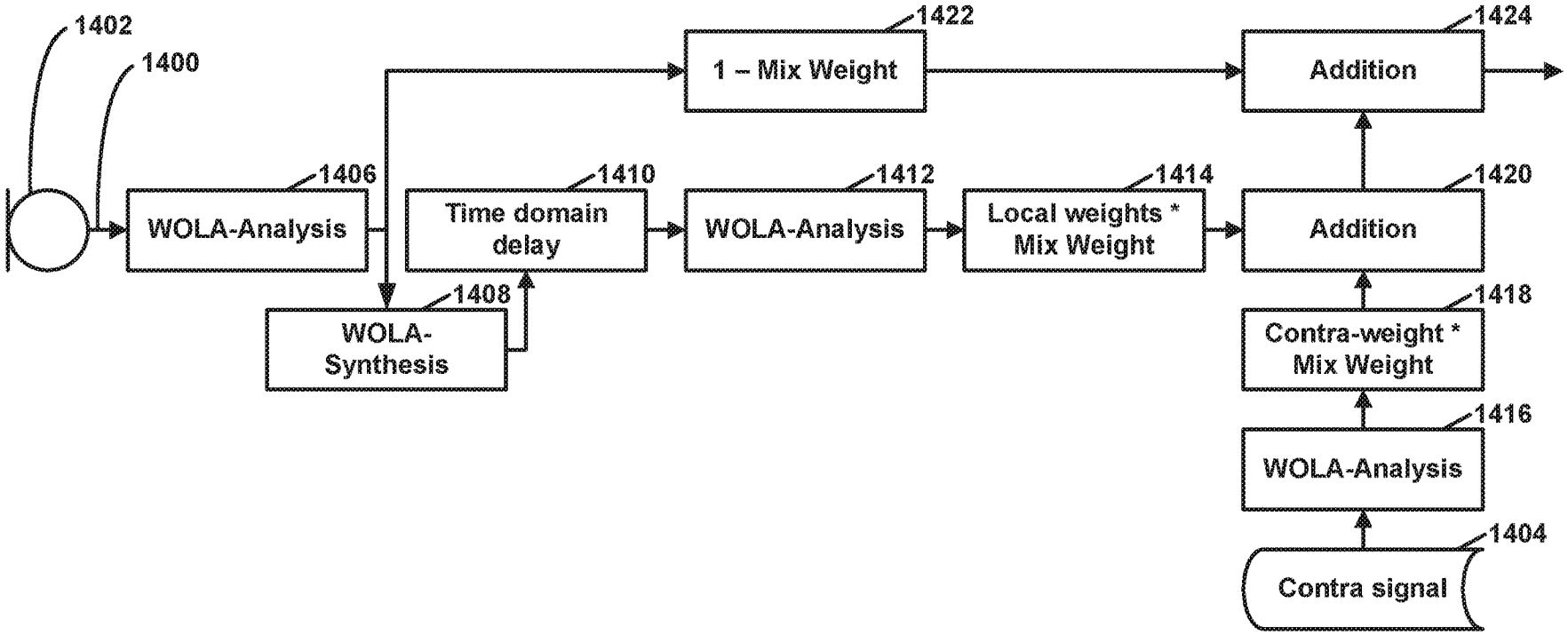
FIG. 14 is a block diagram illustrating an example technique for a binaural beamformer which mixes local bilateral audio with a contra bilateral output signal to create a binaural output audio signal in a frequency domain, in accordance with one or more techniques of this disclosure.

FIG. 14 is a block diagram illustrating an example technique for a binaural beamformer that mixes local a local bilateral audio signal with a contra bilateral audio signal to generate a binaural output audio signal in a frequency domain, in accordance with one or more techniques of this disclosure. The bilateral output audio signal is the output audio signal generated by the local device when the local device is operating in a bilateral mode. The binaural output audio signal is the output audio signal generated by the local device when the local device is operating in the binaural mode. The local device may mix the bilateral output audio signal and the binaural output audio signal during a process of the local device adapting to or from the bilateral mode to the binaural mode or vice versa. Mixing the bilateral output audio signal and the binaural output audio signal may make the transition between the bilateral mode and the binaural mode less jarring to the user.

In the example of FIG. 14, the local device may receive a local input audio signal 1400 generated based on sound detected by a microphone 1402. Microphone 1402 may be microphone 302A or 304A (FIG. 3). Additionally, the local device may receive a contra intermediate audio signal 1404.

The local device may apply a WOLA analysis phase to local input audio signal 1400 (1406). When applying a WOLA analysis phase to a signal, the local device may apply a fast Fourier transform (FFT) to data in an analysis window of the signal, where the analysis window is translated to time zero. By applying the FFT to the data in the analysis window of the signal, the local device generates a set of frequency-domain coefficients. The local device may then perform a WOLA synthesis phase on the set of frequency-domain coefficients generated by applying the WOLA analysis phase to the local input audio signal 1400 (1408). When applying a WOLA synthesis phase, the local device may apply an inverse FFT to the coefficients in the set of frequency-domain coefficients and may then apply a synthesis window to the resulting values to yield a weighted output frame in the time domain.

After applying the WOLA synthesis phase, the local device may apply a time domain delay to the weighted output frame (1410). The purpose of the time delay is to correct for the delay of the wireless transmission. The time domain delay may have a resolution of one time-domain sample. Subsequently, the local device may apply another WOLA analysis phase to the time-delayed weighted output frame (1412), resulting in a second set of frequency-domain values denoted herein as "local weights." Next, the local device may multiply the local weights by a mix weight (e.g., the mix weight determined in FIG. 13) (1414).

Furthermore, in the example of FIG. 14, the local device may apply a WOLA analysis phase to contra intermediate audio signal 1404 (1416). By applying the WOLA analysis phase to contra intermediate audio signal 1404, the local device may generate a set of frequency-domain values denoted as "contra-weights." Next, the local device may multiply the contra weights by the mix weight (1418). The local device may then add (1420) the coefficients resulting from steps (1414) and (1418). Additionally, the local device may determine a mix weight complement value equal to 1 minus the mix weight (1422). The local device may then add (1424) the mix weight complement value to each value produced by step (1420). After step (1424), the local device may perform additional processing steps, such as a step of modifying a gain of the audio signal at particular frequencies to compensate for hearing loss and a step of converting the signal back into the time domain.

The mixing operating of FIG. 14 may be advantageous in that the time-domain delay has a resolution of one time-domain sample. Additionally, the local and contra signals are available in the WOLA (frequency) domain, which may be involved in binaural noise reduction and adaptive binaural beamforming. Furthermore, the local and contra signals may be added with arbitrary weights. The mixing operation of FIG. 14 does not require additional memory for WOLA-domain delay.

In another example, the local device may mix the bilateral output audio stream and the binaural output audio stream in a frequency domain. In this example, the local device uses a frequency domain for the local input audio signal and adds the two signals (i.e., the local input audio signal and the contra input audio signal) in the WOLA domain. In this example, the overall delay of the local input audio signal is applied in the WOLA domain, which may save one WOLA analysis at the expense of more memory usage. Because the WOLA synthesis and WOLA analysis may operate on the same block number, this may restrict the delay to a multiple of the oversampling factor. The block number is a specific of a WOLA-filterbank. There may be a block-dependent phase shift, so the WOLA-analysis and synthesis may need to operate on the same block number, which means that they have to have processed the same number of blocks. However, it may be possible to correct for this block number difference by scaling the local and contra weight with the following factor:

$$\text{wolaScale}=\exp(-li*2*\text{pi}*\text{oversampling}*\text{rem}(\text{localDelay},\text{oversampling})*(0:n\text{FFTi}2-1)/n\text{FFT}/2)$$

In this equation above, li is the imaginary number $\sqrt{-1}$, nFFT is the FFT length in the WOLA (e.g., 32), oversampling is the oversampling factor in the WOLA (nFFT/R), R is the block size in the WOLA, localDelay is the delay on the local side in number of blocks. The resolution of the overall delay may be limited to a whole number of blocks (e.g., 8 time-domain samples). This example may have the advantage of saving one WOLA analysis. Additionally, this example may have the advantage of the local and contra input audio signals being available in the WOLA domain, which may be needed for binaural noise reduction and adaptive binaural beamforming. Furthermore, this example may have the advantage of the local device being able to add arbitrary weights to the local and contra input audio signals.

In another example, the local device may apply a time-domain delay and mix the bilateral output audio stream and the binaural output audio stream in a frequency domain. In this example, the local device applies the overall delay in the time domain and adds the local and contra input audio signals in the WOLA domain. In some instances, the local device may perform the mixing in the time-domain and may apply a first order Infinite Impulse Response (IIR) filter to apply the high pass filter. The high pass filter may be combined with a de-emphasis filter and applied to a down-sampled signal just after a decoder of the local device decodes the encoded audio data that the local device received from the contra device. This example may have an advantage of the time-domain delay having a resolution of one time-domain sample and not requiring additional WOLA analysis or additional memory.

In this disclosure, ordinal terms such as "first," "second," "third." and so on, are not necessarily indicators of positions within an order, but rather may simply be used to distinguish different instances of the same thing. Examples provided in this disclosure may be used together, separately, or in various combinations.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently. e.g., through multi-threaded processing, interrupt processing, or multiple processors, rather than sequentially.

In one or more examples, the functions described may be implemented in hardware, software, firmware, or any combination thereof. For instance, the various beamformers of this disclosure may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processing circuits to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, cache memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. Also, the techniques could be fully implemented in one or more circuits or logic elements. Processing circuits may be coupled to other components in various ways. For example, a processing circuit may be coupled to other components via an internal device interconnect, a wired or wireless network connection, or another communication medium. Various operations described in this disclosure may be performed on digital representations of signals, e.g., in a DSP, but that some operations may be applied to analog signals, such as analog-to-digital conversion (ADC), digital-to-analog conversion (DAC), amplification, some filtering or other processing, may be performed in analog circuits.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. A method for switching operating modes of ear-wearable devices in an auditory device system, the method comprising:

generating, by a local device of the auditory device system, one or more local input audio signals based on sound detected by one or more microphones of the local device, wherein the auditory device system includes the local device and a contra device, the local device and the contra device being ear-wearable devices;

determining, by the local device, a wireless quality parameter indicative of a current environment for wireless communication with the contra device;

estimating, by the local device, based on the one or more local input audio signals, a local background noise level;

estimating, by the local device, a local broadband noise level, the local broadband noise level being an estimate of a noise level in a frequency band broader than a frequency band of the local background noise level;

determining, by the local device, a local target operating mode based on the local background noise level, the local broadband noise level, and the wireless quality parameter, the local target operating mode being either a bilateral mode or a binaural mode;

wirelessly receiving, by the local device, contra status data from the contra device, wherein the contra status data indicates a contra target operating mode and a contra background noise level, the contra target operating mode being a target operating mode as determined by the contra device, and the contra background noise level being a level of background noise as estimated by the contra device; and wirelessly transmitting, by the local device, local status data to the contra device, wherein the local status data indicates the local target operating mode and the local background noise level;

determining, based on the one or more local input audio signals and the wireless quality parameter, by the local device, whether to change a local active operating mode of the local device from the bilateral mode to the binaural mode or from the binaural mode to the bilateral mode, wherein:

the local device makes the determination to change the local active operating mode from the bilateral mode to the binaural mode in response to determining that the local target operating mode and the contra target operating mode are the binaural mode and a difference between the local background noise level and the contra background noise level is less than a noise level difference threshold, and the local device makes the determination to change the local active operating mode from the binaural mode to the bilateral mode in response to determining that either of the local target operating mode or the contra target operating mode is the bilateral mode;

changing, by the local device, the local active operating mode based on the determination whether to change the local active operating mode of the local device from the bilateral mode to the binaural mode or from the binaural mode to the bilateral mode;

generating, by the local device, a local output audio signal based on the one or more local input audio signals in accordance with the local active operating mode; and producing, by a receiver of the local device, sound based on the local output audio signal.

2. The method of claim 1, wherein determining the wireless quality parameter comprises:

wirelessly receiving, by the local device, data from the contra device; and determining, by the local device, the wireless quality parameter based on an error rate in the data.

3. The method of claim 1, wherein wirelessly transmitting the local status data to the contra device comprises:

wirelessly transmitting, by the local device, the local status data to the contra device in response to determining that the local active operating mode is different from the local target operating mode and a sufficient amount of time has passed following a most recent time the local device wirelessly transmitted the local status data to the contra device.

4. The method of claim 1, wherein:

determining the local target operating mode based on the local background noise level, the local broadband noise level, and the wireless quality parameter comprises determining, by the local device, the local target operating mode based on a first comparison, a second comparison, and a third comparison, the first comparison compares the local background noise level to a first threshold and a second threshold, the second comparison compares a difference between the local background noise level and the local broadband noise level to a third threshold, and the third comparison compares a value of the wireless quality parameter to a fourth threshold.

5. The method of claim 4, wherein:

determining the local target operating mode based on the local background noise level, the local broadband noise level, and the wireless quality parameter comprises determining, by the local device, that the local target operating mode is the binaural mode based on the local background noise being greater than the first threshold and less than the second threshold, the difference between the local background noise level and the local broadband noise level being less than the third threshold, and the value of the wireless quality parameter being less than the fourth threshold.

6. The method of claim 1, wherein:

wherein, when the local active operating mode is the binaural mode, the local device wirelessly receives a contra intermediate audio signal from the contra device, generates the local output audio signal based on the one or more local input audio signals and the contra intermediate audio signal, and wirelessly transmits a local intermediate audio signal to the contra device, the local intermediate audio signal being based on the one or more local input audio signals, and wherein, when the local active operating mode is the bilateral mode, the local device does not wirelessly receive the contra intermediate audio signal from the contra device and the local device generates the local output audio signal based on the one or more local input audio signals.

7. An ear-wearable device comprising:

one or more microphones;

a receiver;

a wireless communication system; and one or more processors configured to:

generate one or more local input audio signals based on sound detected by the one or more microphones, wherein the ear-wearable device is a local device, an auditory device system includes the local device and a contra device, and the contra device is a second ear-wearable device;

determine a wireless quality parameter indicative of a current environment for wireless communication with the contra device;

estimate, based on the one or more local input audio signals, a local background noise level;

estimate a local broadband noise level, the local broadband noise level being an estimate of a noise level in a frequency band broader than a frequency band of the local background noise level;

determine a local target operating mode based on the local background noise level, the local broadband noise level, and the wireless quality parameter, the local target operating mode being either a bilateral mode or a binaural mode, wherein the wireless communication system is configured to:

wirelessly receive contra status data from the contra device, wherein the contra status data indicates a contra target operating mode and a contra background noise level, the contra target operating mode being a target operating mode as determined by the contra device, and the contra background noise level being a level of background noise as estimated by the contra device; and wirelessly transmit local status data to the contra device, wherein the local status data indicates the local target operating mode and the local background noise level;

wherein the one or more processors are further configured to determine, based on the one or more local input audio signals and the wireless quality parameter, whether to change a local active operating mode of the local device from the bilateral mode to the binaural mode or from the binaural mode to the bilateral mode, wherein:

the one or more processors are configured to make the determination to change the local active operating mode from the bilateral mode to the binaural mode in response to determining that the local target operating mode and the contra target operating mode are the binaural mode and a difference between the local background noise level and the contra background noise level is less than a noise level difference threshold, and the one or more processors are configured to make the determination to change the local active operating mode from the binaural mode to the bilateral mode in response to determining that either of the local target operating mode or the contra target operating mode is the bilateral mode;

change the local active operating mode based on the determination whether to change the local active operating mode of the local device from the bilateral mode to the binaural mode or from the binaural mode to the bilateral mode;

generate a local output audio signal based on the one or more local input audio signals in accordance with the local active operating mode, wherein the receiver is configured to produce sound based on the local output audio signal.

8. The ear-wearable device of claim 7, wherein:

the wireless communication system is configured to wirelessly receive data from the contra device, and the one or more processors are configured to determine the wireless quality parameter based on an error rate in the data.

9. The ear-wearable device of claim 7, wherein the wireless communication system is configured to wirelessly transmit the local status data to the contra device in response to determining that the local active operating mode is different from the local target operating mode and a sufficient amount of time has passed following a most recent time the local device wirelessly transmitted the local status data to the contra device.

10. The ear-wearable device of claim 7, wherein the one or more processors are configured to:

determine the local target operating mode based on a first comparison, a second comparison, and a third comparison, the first comparison compares the local background noise level to a first threshold and a second threshold, the second comparison compares a difference between the local background noise level and the local broadband noise level to a third threshold, and the third comparison compares a value of the wireless quality parameter to a fourth threshold.

11. The ear-wearable device of claim 10, wherein the one or more processors are configured to determine that the local target operating mode is the binaural mode based on the local background noise being greater than the first threshold and less than the second threshold, the difference between the local background noise level and the local broadband noise level being less than the third threshold, and the value of the wireless quality parameter being less than the fourth threshold.

12. The ear-wearable device of claim 7, wherein:

the ear-wearable device comprises a wireless communication system, when the local active operating mode is the binaural mode, the local device wirelessly receives a contra intermediate audio signal from the contra device, generates the local output audio signal based on the one or more local input audio signals and the contra intermediate audio signal, and wirelessly transmits a local intermediate audio signal to the contra device, the local intermediate audio signal being based on the one or more local input audio signals, and when the local active operating mode is the bilateral mode, the local device does not wirelessly receive the contra intermediate audio signal from the contra device and the local device generates the local output audio signal based on the one or more local input audio signals.

13. An ear-wearable device comprising:

means for generating one or more local input audio signals based on sound detected by one or more microphones of the ear-wearable device, wherein the ear-wearable device is a local device, an auditory device system includes the local device and a contra device, and the contra device being is another ear-wearable device;

means for determining a wireless quality parameter indicative of a current environment for wireless communication with the contra device;

means for estimating, based on the one or more local input audio signals, a local background noise level;

means for estimating a local broadband noise level, the local broadband noise level being an estimate of a noise level in a frequency band broader than a frequency band of the local background noise level;

means for determining a local target operating mode based on the local background noise level, the local broadband noise level, and the wireless quality parameter, the local target operating mode being either a bilateral mode or a binaural mode;

means for wirelessly receiving contra status data from the contra device, wherein the contra status data indicates a contra target operating mode and a contra background noise level, the contra target operating mode being a target operating mode as determined by the contra device, and the contra background noise level being a level of background noise as estimated by the contra device; and means for wirelessly transmitting local status data to the contra device, wherein the local status data indicates the local target operating mode and the local background noise level;

means for determining, based on the one or more local input audio signals and the wireless quality parameter, whether to change a local active operating mode of the local device from the bilateral mode to the binaural mode or from the binaural mode to the bilateral mode, wherein:

the means for determining includes means for making the determination to change the local active operating mode from the bilateral mode to the binaural mode in response to determining that the local target operating mode and the contra target operating mode are the binaural mode and a difference between the local background noise level and the contra background noise level is less than a noise level difference threshold, and the means for determining includes means for making the determination to change the local active operating mode from the binaural mode to the bilateral mode in response to determining that either of the local target operating mode or the contra target operating mode is the bilateral mode;

means for changing the local active operating mode based on the determination whether to change the local active operating mode of the local device from the bilateral mode to the binaural mode or from the binaural mode to the bilateral mode;

means for generating a local output audio signal based on the one or more local input audio signals in accordance with the local active operating mode; and means for producing sound based on the local output audio signal.

14. The ear-wearable device of claim 13, wherein, when the local active operating mode is the binaural mode, the local device wirelessly receives a contra intermediate audio signal from the contra device, generates the local output audio signal based on the one or more local input audio signals and the contra intermediate audio signal, and wirelessly transmits a local intermediate audio signal to the contra device, the local intermediate audio signal being based on the one or more local input audio signals, and wherein, when the local active operating mode is the bilateral mode, the local device does not wirelessly receive the contra intermediate audio signal from the contra device and the local device generates the local output audio signal based on the one or more local input audio signals.

* * * * *